US012342914B2

(12) United States Patent
De Vos et al.

(10) Patent No.: US 12,342,914 B2
(45) **Date of Patent: *Jul. 1, 2025**

(54) LUGGAGE ARTICLE SPLIT ALONG FRONT AND REAR MAJOR FACES

(71) Applicant: Samsonite IP Holdings S.a r.l., Luxembourg (LU)

(72) Inventors: Wim De Vos, Zingem (BE); Erik Sijmons, Oudenaarde (BE); Jurgen Oskamp, Mechelen (BE); Ward Vancoppenolle, Mechelen (BE); Lukas Van Campenhout, Mechelen (BE); Reinhard Meersschaert, Merelbeke (BE); Ward Adriaenssens, Mechelen (BE)

(73) Assignee: Samsonite IP Holdings S.a r.l., Luxembourg (LU)

( * ) Notice: Subject to any disclaimer, the term of this patent is extended or adjusted under 35 U.S.C. 154(b) by 0 days.

This patent is subject to a terminal disclaimer.

(21) Appl. No.: 18/209,614

(22) Filed: Jun. 14, 2023

(65) Prior Publication Data

US 2023/0337796 A1 Oct. 26, 2023

Related U.S. Application Data

(63) Continuation of application No. 17/251,893, filed as application No. PCT/EP2018/065713 on Jun. 13, 2018, now Pat. No. 11,712,094.

(51) Int. Cl.
*A45C 5/03* (2006.01)
*A45C 5/14* (2006.01)
(Continued)

(52) U.S. Cl.
CPC ..... *A45C 5/03* (2013.01); *A45C 5/14* (2013.01); *A45C 13/005* (2013.01); *A45C 13/02* (2013.01);
(Continued)

(58) Field of Classification Search
CPC ..... A45C 5/03; A45C 5/14; A45C 13/005; A45C 13/02; A45C 13/262; A45C 2005/037; A45C 2013/267
See application file for complete search history.

(56) References Cited

U.S. PATENT DOCUMENTS 743,537 A * 11/1903 Mendel ..... A47B 61/06 223/91
1,074,133 A 9/1913 Neustaedter
(Continued)

FOREIGN PATENT DOCUMENTS

CN 1080148 A 1/1994
CN 2163563 Y 5/1994
(Continued)

OTHER PUBLICATIONS

Extended European Search Report for European Patent Application No. 23190429.3 dated Dec. 5, 2023, 7 pages.
(Continued)

*Primary Examiner* — Tri M Mai
(74) *Attorney, Agent, or Firm* — Dorsey & Whitney LLP

(57) ABSTRACT

A luggage article split along front and rear major faces is provided. The luggage article may include a housing defined by first and second shell portions pivotably connected together at a split line. The housing may define a front major face, a rear major face, and a plurality of minor faces extending between the front and rear major faces. The front and rear major faces may have a width dimension greater than each of the plurality of minor faces. The split line may extend along the front and rear major faces of the housing.

15 Claims, 12 Drawing Sheets

(51) Int. Cl.
*A45C 13/00* (2006.01)
*A45C 13/02* (2006.01)
*A45C 13/26* (2006.01)

(52) U.S. Cl.
CPC ..... *A45C 13/262* (2013.01); *A45C 2005/037* (2013.01); *A45C 2013/267* (2013.01)

(56) References Cited

U.S. PATENT DOCUMENTS

| | | | | |
|---|---|---|---|---|
| 1,310,571 | A * | 7/1919 | Hotchkiss | A45C 11/20 206/541 |
| 1,710,713 | A * | 4/1929 | Ritter, Jr. | A45C 13/36 190/13 R |
| 2,392,926 | A | 1/1946 | Allcott | |
| 3,506,112 | A * | 4/1970 | Feinberg | A45C 11/00 312/351 |
| 3,799,568 | A | 3/1974 | Hager | |
| 3,934,895 | A | 1/1976 | Fox | |
| 3,948,365 | A | 4/1976 | Gregg et al. | |
| 4,291,915 | A * | 9/1981 | Cox | B60N 2/2866 297/188.1 |
| 4,561,526 | A | 12/1985 | Winter et al. | |
| 4,854,432 | A | 8/1989 | Carpenter et al. | |
| 5,253,739 | A | 10/1993 | King | |
| 5,353,900 | A | 10/1994 | Stilley | |
| 5,400,494 | A | 3/1995 | Stilley | |
| 5,590,748 | A | 1/1997 | Chang | |
| 5,647,095 | A | 7/1997 | Takimoto | |
| 5,924,533 | A | 7/1999 | Cnockaert et al. | |
| 5,947,286 | A | 9/1999 | Chau | |
| 6,305,513 | B1 | 10/2001 | Lu | |
| 6,435,324 | B1 | 8/2002 | Hoberman et al. | |
| 6,964,420 | B1 * | 11/2005 | Ghanizadeh | A45C 13/10 190/110 |
| 7,461,730 | B2 * | 12/2008 | Costa | A45C 13/262 190/115 |
| 7,712,752 | B2 | 5/2010 | Horning | |
| 7,874,408 | B2 | 1/2011 | Suppancig | |
| 8,602,185 | B1 | 12/2013 | White | |
| 8,607,947 | B2 | 12/2013 | Morszeck | |
| 8,695,770 | B2 | 4/2014 | Santy | |
| 9,357,821 | B1 | 6/2016 | Montoya | |
| 11,712,094 | B2 * | 8/2023 | De Vos | A45C 5/14 190/18 A |
| 2002/0050429 | A1 * | 5/2002 | Nykoluk | A45C 13/262 280/37 |
| 2004/0045780 | A1 | 3/2004 | Bernbaum et al. | |
| 2005/0098402 | A1 | 5/2005 | Cohen | |
| 2008/0251340 | A1 * | 10/2008 | Huber | A45C 3/12 190/112 |
| 2009/0166138 | A1 | 7/2009 | Gorga | |
| 2009/0301833 | A1 | 12/2009 | Hymas | |
| 2011/0000754 | A1 | 1/2011 | Chauhan et al. | |
| 2012/0018266 | A1 | 1/2012 | Ziv et al. | |
| 2013/0140118 | A1 | 6/2013 | Benshetrit et al. | |
| 2015/0021132 | A1 | 1/2015 | Sijmons et al. | |
| 2019/0142123 | A1 * | 5/2019 | Yu | A45C 13/103 190/108 |
| 2019/0328099 | A1 * | 10/2019 | Tayne | A45C 13/262 |
| 2021/0120925 | A1 | 4/2021 | De Vos et al. | |

FOREIGN PATENT DOCUMENTS

| | | | |
|---|---|---|---|
| CN | 2378999 | Y | 5/2000 |
| CN | 2516013 | Y | 10/2002 |
| CN | 2580815 | Y | 10/2003 |
| CN | 201240209 | Y | 5/2009 |
| CN | 103300567 | A | 9/2013 |
| CN | 103799652 | A | 5/2014 |
| CN | 203748822 | U | 8/2014 |
| CN | 204132626 | U | 2/2015 |
| CN | 105054539 | A | 11/2015 |
| CN | 204812496 | U | 12/2015 |
| CN | 103300567 | B | 3/2016 |
| CN | 205658510 | U | 10/2016 |
| CN | 206197276 | U | 5/2017 |
| CN | 206275299 | U | 6/2017 |
| CN | 206852221 | U | 1/2018 |
| CN | 207168027 | U | 4/2018 |
| DE | 4221215 | A1 | 1/1994 |
| DE | 202008012595 | U1 | 11/2008 |
| EM | 0065654380001 | | 6/2019 |
| EM | 0065654380002 | | 6/2019 |
| EM | 0065654380003 | | 6/2019 |
| EP | 0015827 | A1 | 9/1980 |
| EP | 0106906 | B1 | 7/1986 |
| EP | 0379438 | B1 | 7/1990 |
| EP | 0517803 | B1 | 10/1996 |
| EP | 0900535 | A1 | 3/1999 |
| EP | 0729718 | B1 | 10/1999 |
| EP | 1833320 | A2 | 9/2007 |
| EP | 1833320 | B1 | 4/2014 |
| EP | 2230959 | B1 | 5/2014 |
| EP | 2467040 | B1 | 6/2014 |
| EP | 2904926 | B1 | 7/2017 |
| EP | 3073853 | B1 | 8/2017 |
| EP | 4298951 | | 1/2024 |
| FR | 2711044 | B1 | 8/1997 |
| FR | 2921237 | A1 | 3/2009 |
| GB | 161117 | A | 4/1921 |
| GB | 552374 | A | 4/1943 |
| GB | 676355 | A | 7/1952 |
| GB | 2171079 | B | 9/1988 |
| GB | 2338703 | B | 5/2000 |
| GB | 2488116 | B | 2/2013 |
| GB | 2532925 | A | 6/2016 |
| JP | S54106905 | U | 7/1979 |
| JP | S5572425 | U | 5/1980 |
| JP | S59145829 | U | 9/1984 |
| JP | S6013020 | U | 1/1985 |
| JP | H06-042492 | | 11/1994 |
| JP | 3197681 | U | 4/2015 |
| JP | 2017164493 | A | 9/2017 |
| KR | 20130089371 | A | 8/2013 |
| TW | 283890 | U | 8/1996 |
| WO | 9524839 | A1 | 9/1995 |
| WO | 2004080228 | A2 | 9/2004 |
| WO | 2019238228 | A1 | 12/2019 |

OTHER PUBLICATIONS

International Search Report and Written Opinion for International Patent Application No. PCT/EP2018/065713, Feb. 21, 2019, 26 pages.

* cited by examiner

LUGGAGE ARTICLE SPLIT ALONG FRONT AND REAR MAJOR FACES

CROSS REFERENCE TO RELATED APPLICATIONS

This application is a continuation of U.S. patent application Ser. No. 17/251,893 filed on Dec. 14, 2020 and entitled "Luggage Article Split Along Front and Rear Major Faces", which is a national stage application of International Patent Application No. PCT/EP2018/065713 filed on Jun. 13, 2018 and entitled "Luggage Article Split Along Front and Rear Major Faces", the entire contents of which are hereby incorporated by reference herein in their entireties.

TECHNICAL FIELD

The present disclosure relates generally to luggage articles, and more specifically to a luggage article split along front and rear major faces.

BACKGROUND

Traditional luggage cases include a split construction with first and second shells or halves defined at a split line defined along the minor faces of the case. For example, traditional luggage case configurations define the split line along top, bottom, left and right minor faces of the case. With this split line location, each shell or half is relatively shallow compared to its width, and when open for packing also takes up about twice the space as an unopened luggage case. This configuration can make packing certain types of articles difficult and less convenient when in tight quarters.

It is therefore desirable to provide an improved luggage case that addresses one or all of the above described problems and/or which more generally offers improvements or an alternative to existing arrangements.

Documents that may be related to the present disclosure include CN2163563Y, CN2378999Y, CN1033000567B, CN201240209Y, CN205658510U, CN206275299U, DE4221215A1, EP0015827A1, EP0106906B1, EP0379438B1, EP0517803B1, EP0729718B1, EP0900535A1, EP1833320A1, EP2230959B1, EP2467040B1, EP2904926B1, EP3073853B1, FR2711044B1, FR2921237A1, GB161117A, GB552374A, GB676355A, GB2171079B, GB2338703B, GB2488116B, GB2532925A, TW283890B, U.S. Pat. Nos. 2,392,926A, 3,799,568A, 3,948,365A, 4,561,526A, 4,854,432A, 5,253,739A, 5,400,494A, 5,590,748A, 5,924,533A, 5,947,286A, 6,305,513B1, 6,435,324B1, 7,712,752B2, 7,874,408B2, 8,602,185B1, US20040045780A1, US20050098402A1, US20090166138A1, and US20090301833A1.

SUMMARY

The present disclosure provides a luggage article split along its front and rear major faces, as described below and defined in the accompanying claims. The luggage article may include a housing defining a front major face, a rear major face, and a plurality of minor faces extending between the front and rear major faces. The front and rear major faces include a width dimension greater than each of the plurality of minor faces. The housing may be defined by first and second shell portions pivotably connected together at a split line extending along the front and rear major faces of the housing. The first and second shell portions may be pivotably connected together by a hinge positioned on the rear major face of the housing. The luggage article may include separately or additionally an internal carry handle positioned within the internal storage volume of the housing and accessible when the first and second shell portions are in an open configuration. The luggage article may separately or additionally include a retractable tow handle extending along the hinge on the rear major face of the housing. The luggage article may include separately or additionally a side carry handle on a lateral side of the housing. The luggage article may include separately or additionally a top carry handle positioned at the intersection of the top and lateral sides of the housing. The luggage article may include separately or additionally a closure mechanism securing the first and second shell portions together at the split line, with the closure mechanism positioned on one of the major faces of the housing and opposite of the hinge.

According to a first aspect of the present disclosure, there is provided a luggage article. The luggage article may include a housing defined by first and second shell portions pivotably connected together at a split line. The housing may define a front major face, a rear major face, and a plurality of minor faces extending between the front and rear major faces. The front and rear major faces may have a width dimension greater than each of the plurality of minor faces. The split line may extend along the front and rear major faces of the housing.

Optionally, the plurality of minor faces may include opposing top and bottom minor faces and opposing left and right minor faces. The split line may extend along the top and bottom minor faces.

Optionally, in an open configuration the first and second shell portions may define peripheral rims defining respective openings into a storage space, each opening having a length greater than its width. The storage space in each shell portion may be deeper than it is wide.

Optionally, in an open configuration the rear major face may form a sidewall of each of the first and second portions. The sidewalls defined by the rear major face may be adjacent to each other in an open configuration. The sidewalls may engage and limit further pivoting of the first and second shell portions about a hinge.

Optionally, the luggage article may include a hinge having a pivot axis and pivotably connecting the first and second shell portions together along a portion of the split line. The hinge may be defined on the rear major face of the housing.

Optionally, the first and second shell portions may be movable between a closed configuration in which the first and second shell portions abut each other to define a substantially enclosed internal storage volume, and an open configuration in which the first shell portion is pivoted away from the second shell portion to allow user access to the internal storage volume. The luggage article may include an internal carry handle positioned within the internal storage volume and accessible when the first and second shell portions are in the open configuration. The internal carry handle may be connected to the housing in alignment with the split line. The internal carry handle may be connected to the first and second shell portions at the split line. The internal carry handle may be positioned over a central region or the center of gravity of the luggage article when the first and second shell portions are in the open configuration. The internal carry handle may include a grip including opposing ends defining a length therebetween. The length of the grip may be sufficient to allow the grip to be grasped with two hands side-by-side.

Optionally, the luggage article may include a closure mechanism securing the first and second shell portions together at the split line. The closure mechanism may be positioned along at least a portion of the split line on the front major face and opposite of the hinge. The closure mechanism is a latch. The latch may be positioned within a recess defined in the housing. The housing may include recessed portions defined in both the first shell portion and the second shell portion such that the recessed portions combine to define the recess when the first and second shell portions are connected together.

Optionally, the luggage article may include a retractable tow handle connected to the rear major face of the housing and adjacent to the hinge. The tow handle may include one or more extensible tubes or poles and a grip portion connected to a distal end of each of the one or more extensible tubes or poles. The tow handle may be movable between a retracted position and an extended position. In the retracted position the grip portion may be positioned near or adjacent to one of the plurality of minor faces. In the extended position the grip portion may be moved away from the one of the plurality of minor faces. The grip portion may be received in a recess formed in the housing and may be generally flush with the one of the plurality of minor faces when the tow handle is positioned in the retracted position. The tow handle may be offset laterally from the hinge into either the first shell portion or the second shell portion. The tow handle may be integrated into the hinge such that the tow handle extends along at least a part of the pivot axis. The grip portion may extend parallel to the split line.

Optionally, the housing may define opposing front and rear panels, opposing top and bottom panels, and opposing left and right panels. The luggage article may include a plurality of spinner wheel assemblies connected to the bottom panel. The luggage article may include a first upper corner region defined by the intersection of at least the top panel and the right panel. The luggage article may include a first top carry handle positioned at or near the first upper corner region. The luggage article may include a first side carry handle positioned on the right panel of the housing. The luggage article may include a second upper corner region defined by the intersection of at least the top panel and the left panel. The luggage article may include a second top carry handle positioned at or near the second upper corner region. The luggage article may include a second side carry handle positioned on the left panel. Each top carry handle and each side carry handle may be positioned along a centerline of the housing between the front and rear major faces of the housing. Each top carry handle and each side carry handle may be positioned within a respective recess defined in the housing. Each top carry handle and each side carry handle may be biased to retract into its respective recess when not in use.

According to a second aspect of the present disclosure, there is provided a luggage article. The luggage article may include a housing defined by first and second shell portions pivotably connected together at a split line. The housing may define a front major face, a rear major face, and a plurality of minor faces extending between the front and rear major faces. The front and rear major faces may have a width dimension greater than each of the plurality of minor faces. The split line may extend along the front and rear major faces of the housing.

Optionally, the plurality of minor faces may include opposing top and bottom minor faces and opposing left and right minor faces. The split line may extend along the top and bottom minor faces. The split line may extend in a straight line parallel to the left and right minor faces. The luggage article may include a plurality of spinner wheel assemblies connected to the bottom minor face of the housing.

Optionally, the luggage article may include a hinge having a pivot axis and pivotably connecting the first and second shell portions together along a portion of the split line. The hinge may be defined on the rear major face of the housing. The luggage article may include a retractable tow handle connected to the rear major face of the housing and adjacent to the hinge. The tow handle may include a grip portion and may be movable between a retracted position and an extended position. In the retracted position the grip portion may be positioned near or adjacent to one of the plurality of minor faces. In the extended position the grip portion may be moved away from the one of the plurality of minor faces. The tow handle may be offset from the hinge into either the first shell portion or the second shell portion. The tow handle may be integrated into the hinge such that the tow handle extends along at least a part of the pivot axis. The tow handle may include one or more extensible tubes or poles. The grip portion may be connected to a distal end of each of the one or more extensible tubes or poles. The grip portion may be received in a recess formed in the housing and may be generally flush with the one of the plurality of minor faces when the tow handle is positioned in the retracted position. The grip portion may extend parallel to the split line. The tow handle may include a single pole configuration.

Optionally, the first and second shell portions may be formed from hard side material.

Optionally, in an open configuration the first and second shell portions may define peripheral rims defining respective openings into a storage space. Each opening may have a length greater than its width. The storage space in each shell portion may be deeper than it is wide.

Optionally, in an open configuration the rear major face may form a sidewall of each of the first and second portions. In an open configuration, the sidewalls defined by the rear major face may be adjacent to each. The sidewalls may engage and limit further pivoting of the first and second shell portions about a hinge.

According to a third aspect of the present disclosure, there is provided a luggage article including a housing and an internal carry handle within the interior of the housing. The housing may include first and second shell portions movably, such as hingedly, connected together at a split line. The first and second shell portions may be movable between a closed configuration in which the first and second shell portions abut each other to define a substantially enclosed internal storage volume, and an open configuration in which the first shell portion is pivoted away from the second shell portion to allow user access to the internal storage volume. The internal carry handle may be positioned within the internal storage volume and may be accessible when the first and second shell portions are in the open configuration. The internal carry handle may be connected to the housing in alignment with the split line.

Optionally, the internal carry handle may be connected to the first and second shell portions at the split line. The internal carry handle may be positioned over a hinge hingedly connecting the first and second shell portions together. The internal carry handle may be connected to the hinge.

Optionally, the internal carry handle may be positioned over a central region or the center of gravity of the luggage article when the first and second shell portions are in the open configuration.

Optionally, the internal carry handle may be connected to a peripheral rim of each of the first and second shell portions.

Optionally, the internal carry handle may include a grip including opposing ends defining a length therebetween. The length of the grip may be sufficient to allow the grip to be grasped with two hands side-by-side.

According to a fourth aspect of the present disclosure, there is provided a luggage article including a housing and a retractable tow handle connected to the housing. The housing may be defined by first and second shell portions defining a front major face, a rear major face, and a plurality of minor faces extending between the front and rear major faces. The first and second shell portions may be divided by a split line extending along the front and rear major faces. The first and second shell portions may be pivotably connected together by a hinge positioned along a portion of the split line, the hinge defining a pivot axis. The retractable tow handle may extend along the hinge. The tow handle may include an extensible tube or pole extending coextensively with, along, or closely proximate to the pivot axis.

Optionally, the extensible tube or pole may define a hinge pin about which the first and second shell portions pivot.

Optionally, the hinge and tow handle may extend along the rear major face of the housing. The hinge and tow handle may be positioned centrally on the rear major face of the housing.

Optionally, the first and second shell portions may be selectively connected together along a single split line.

Optionally, the plurality of minor faces may include opposing top and bottom minor faces and opposing left and right minor faces. The split line may extend along the top and bottom minor faces.

Optionally, the tow handle may include a grip portion connected to a distal end of each extensible tube or pole. The grip portion may be received in a recess formed in the housing and may be generally flush with one of the plurality of minor faces when the tow handle is positioned in a retracted position. The grip portion may extend parallel to the split line. The grip portion may include a plurality of parts pivotably connected together. The plurality of parts may be in a first configuration when the luggage article is in a closed configuration. The plurality of parts may be in a second configuration when the luggage article is in an open configuration.

Optionally, the tow handle may include a single pole configuration.

Optionally, the tow handle may include a dual pole configuration with a first extensible pole extending coextensively with, along, or closely proximate to the pivot axis and a second extensible pole extending along a portion of the split line opposite of the hinge.

Optionally, the housing may include an intermediate panel overlying the split line between the first and second shell portions. The intermediate panel may include opposing lateral edges that are pivotably connected to the first and second shell portions. The tow handle may be integrated into the intermediate panel.

According to a fifth aspect of the present disclosure, there is provided a luggage article including a housing, a plurality of spinner wheel assemblies connected to the bottom of the housing, a top carry handle positioned at or near a top corner of the housing, and a side carry handle positioned on a lateral side panel of the housing. The housing may define opposing front and rear panels, opposing top and bottom panels, and opposing left and right panels. The plurality of spinner wheel assemblies may be connected to the bottom panel of the housing. A first upper corner region may be defined by the intersection of at least the top panel and the right panel of the housing. A first top carry handle may be positioned at or near the first upper corner region. A first side carry handle may be positioned on the right panel of the housing.

Optionally, the luggage article may include a second upper corner region defined by the intersection of at least the top panel and the left panel. A second top carry handle may be positioned at or near the second upper corner region. A second side carry handle may be positioned on the left panel of the housing.

Optionally, each top carry handle and each side carry handle may be positioned along a centerline of the luggage between the front and rear panels of the housing.

Optionally, each side carry handle may extend parallel to a height dimension between the top and bottom panels of the housing.

Optionally, each top carry handle and each side carry handle may be positioned within a respective recess defined in the housing. Each top carry handle and each side carry handle may be biased to retract into its respective recess when not in use.

Optionally, each top carry handle and each side carry handle may include a grip with opposing ends connected to the housing.

Optionally, each top carry handle may extend perpendicular to each side carry handle.

According to a sixth aspect of the present disclosure, there is provided a luggage article including a housing and a closure mechanism securing shell portions of the housing together. The housing may be defined by first and second shell portions pivotably connected together at a split line by a hinge. The housing may define a front major face, a rear major face, and a plurality of minor faces extending between the front and rear major faces. The split line may extend along the front and rear major faces of the housing. The closure mechanism may secure the first and second shell portions together at the split line. The closure mechanism may be positioned along at least a portion of the split line on one of the front and rear major faces and opposite of the hinge.

Optionally, the plurality of minor faces may include opposing top and bottom minor faces and opposing left and right minor faces. The split line may extend along the top and bottom minor faces.

Optionally, the hinge may be positioned on the rear major face. The closure mechanism may be positioned on the front major face. The closure mechanism may be positioned centrally in the front major face.

Optionally, the closure mechanism may be a zip closure.

Optionally, the closure mechanism may be a latch. The latch may be positioned within a recess defined in the housing. The housing may include recessed portions defined in both the first shell portion and the second shell portion such that the recessed portions combine to define the recess when the first and second shell portions are connected together. The latch may include a square shape.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various examples of the present disclosure and should not be construed as a complete recitation of the scope of the disclosure, characterized in that.

DETAILED DESCRIPTION

Figure 1:
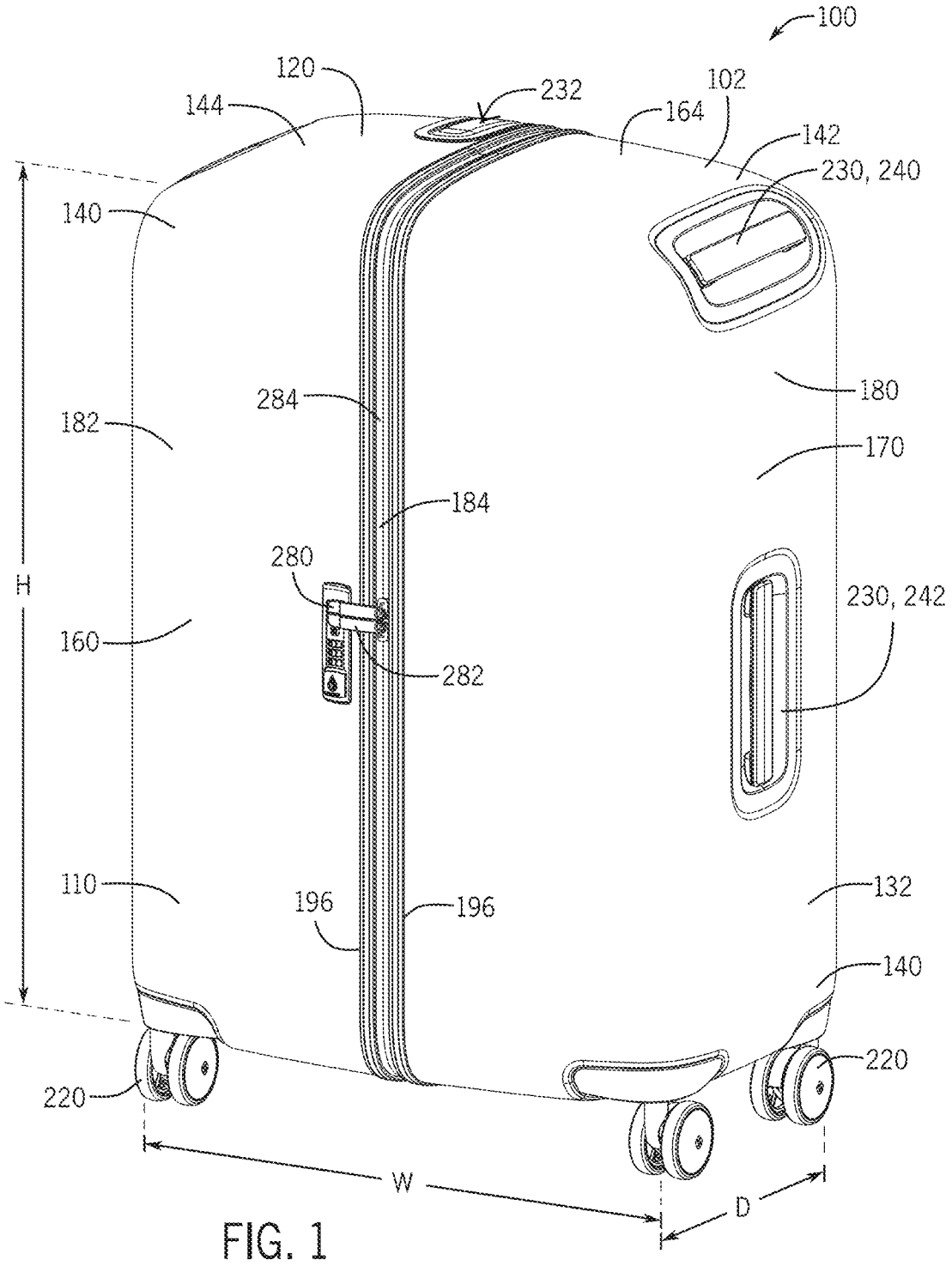
FIG. 1 is a front isometric view of a luggage article according to some examples of the present disclosure.

According to the present disclosure, a luggage article is provided that is split along its front and rear major faces. The luggage article may include a housing defining a front major face, a rear major face, and a plurality of minor faces extending between the front and rear major faces. The front and rear major faces include a width dimension greater than each of the plurality of minor faces. The housing may be defined by first and second shell portions pivotably connected together at a split line extending at least partially along the front and rear major faces of the housing. The first and second shell portions may be pivotably connected together by a hinge positioned on the rear major face of the housing. The luggage article may include other features for convenience, including any combination or subset of the following: an internal carry handle, a retractable tow handle extending along the hinge on the rear major face of the housing, one or more carry handles positioned at the intersection of the top and lateral sides of the housing, and a closure mechanism positioned on one of the major faces of the housing and opposite of the hinge, each as described in detail below.

FIGS. 1-4 illustrate an exemplary luggage article 100 according to some examples of the present disclosure. The luggage article 100 includes a housing 102 formed from a plurality of walls or panels (hereinafter "panels" for the sake of convenience without intent to limit) defining an internal storage volume 104 in which to carry a user's belongings. In one example, the housing 102, may be formed from opposing front and rear panels 110, 112 and a plurality of side panels extending between the front and rear panels 110, 112. For instance, the luggage article 100 may include opposing top and bottom panels 120, 122 and opposing left and right side panels 130, 132 extending between the front and rear panels 110, 112. Corner regions 140 may be defined by the intersection of any two or three adjacent panels. For example, corners formed by the intersection of any three adjacent panels may be considered a "corner region." Edges formed by the intersection of any two adjacent panels may also be considered a "corner region." The luggage article 100 may include a first upper corner region 142 defined by the intersection of at least the top panel 120 and the right side panel 132. A second upper corner region 144 may be defined by the intersection of at least the top panel 120 and the left side panel 130.

The various panels may be configured or arranged to provide a desired size and shape of the housing 102. As shown in FIG. 1, the various panels may be sized and shaped to provide a height H, width W, and depth D of the housing 102. The height H of the housing 102 may be defined as the distance between the top and bottom panels 120, 122. The width W of the housing 102 may be defined as the distance between the left and right side panels 130, 132. Similarly, the depth D of the housing 102 may be defined as the distance between the front and rear panels 110, 112. The panels may be sized and shaped such that the luggage article 100 is taller than it is wide and wider than it is deep, such as that shown in at least FIG. 1. Other sizes and shapes of the housing 102 are contemplated, and the examples shown and described are for illustration purposes only.

Figure 2:
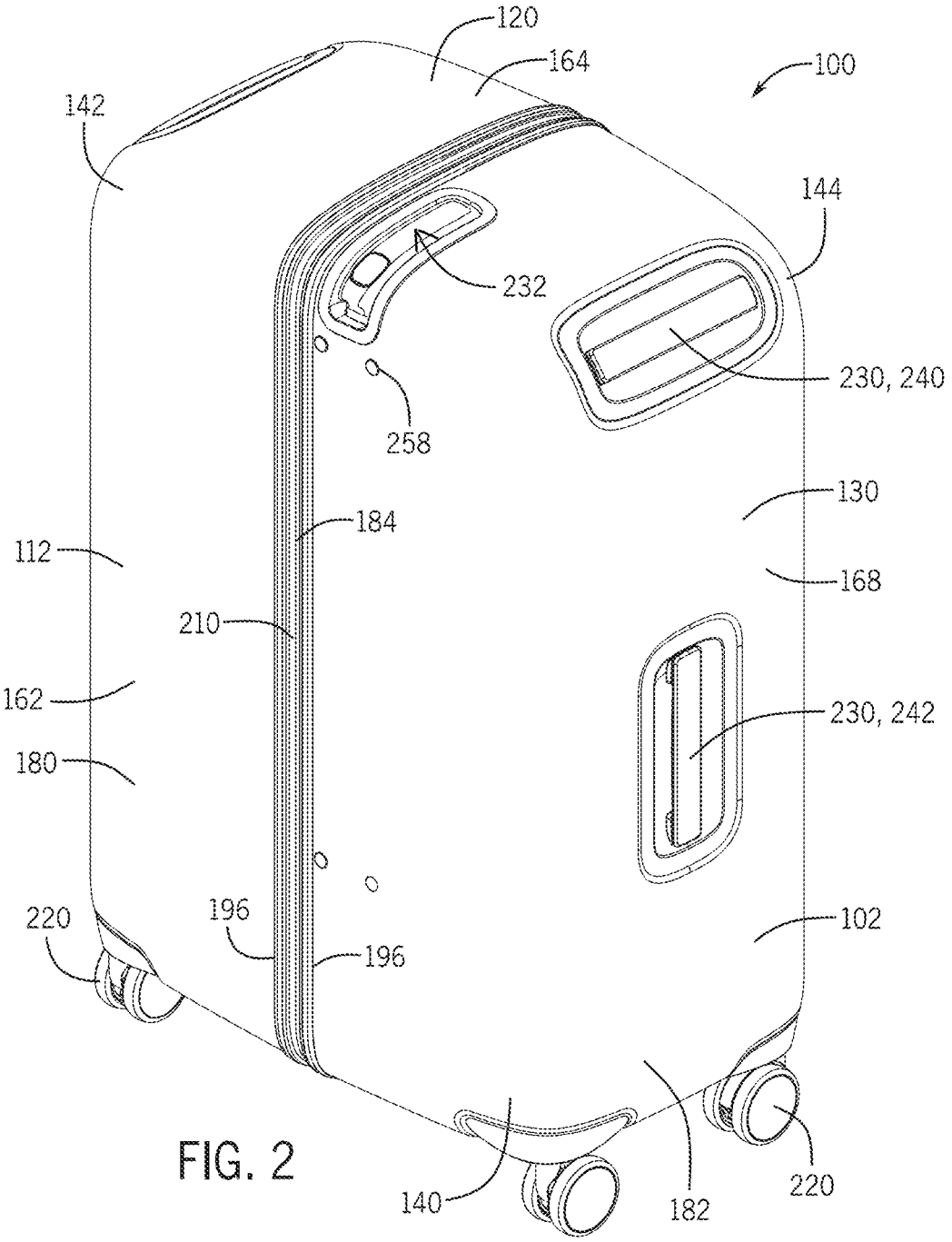
FIG. 2 is a rear isometric view of the luggage article of FIG. 1 and showing a retractable tow handle in a retracted position.
Figure 3:
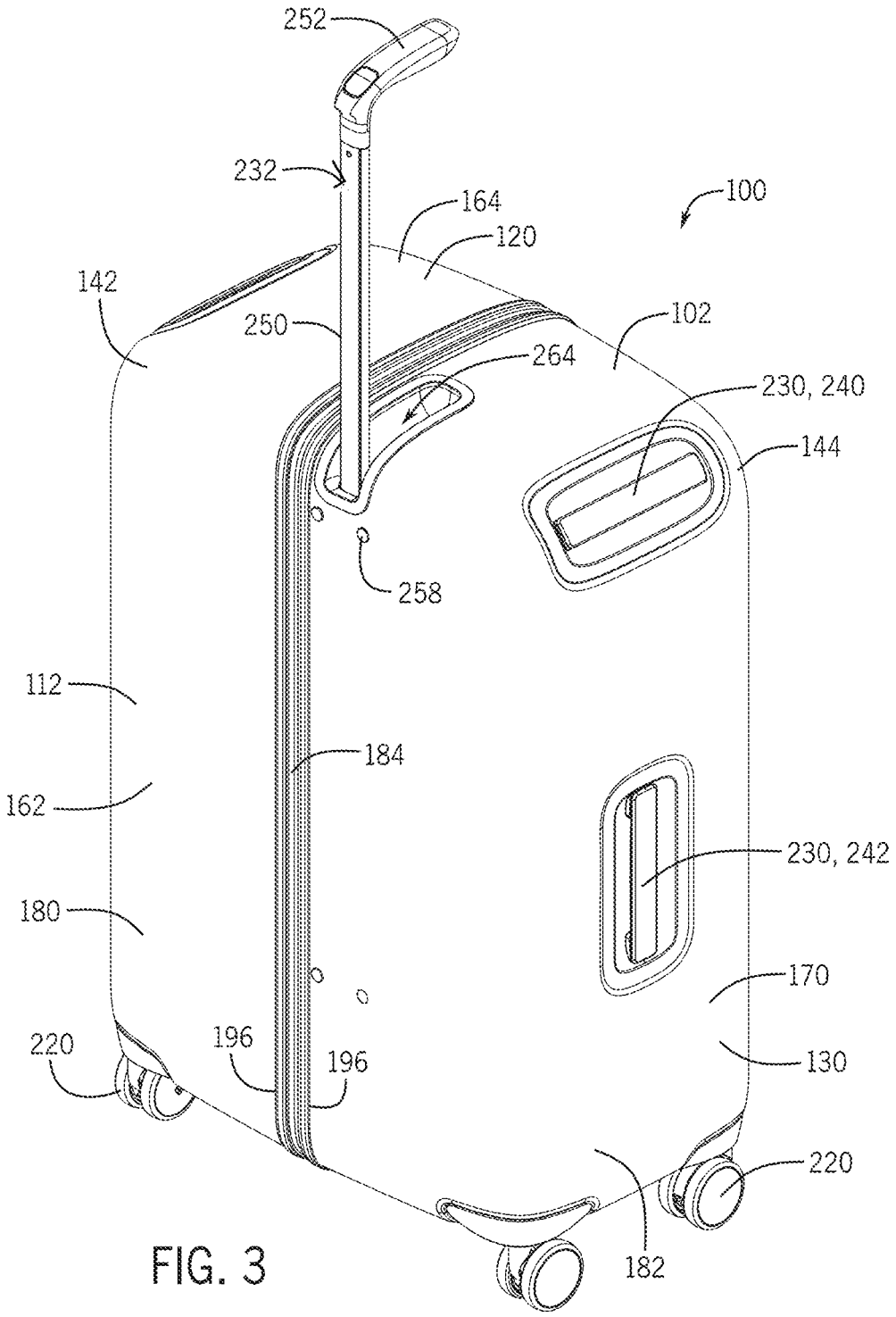
FIG. 3 is a rear isometric view of the luggage article of FIG. 1 and showing a retractable tow handle in an extended position.

Referring to FIGS. 1-3, the housing 102 may define opposing major faces of the luggage article 100 and a plurality of minor faces extending between the major faces. For instance, the front and rear panels 110, 112 of the housing 102 may define front and rear major faces 160, 162. Similarly, the top and bottom panels 120, 122 of the housing 102 may define top and bottom minor faces 164, 166, and the left and right side panels 130, 132 of the housing 102 may define left and right minor faces 168, 170. Each face includes a height and a width. The height and width of the front and rear major faces 160, 162 generally correspond respectively to the height H and width W of the housing 102. The height and width of the left and right minor faces 168, 170 generally correspond respectively to the height H and depth D of the housing 102. The height and width of the top and bottom minor faces 164, 166 correspond respectively to the width W and depth D of the housing 102. As described herein, the front and rear major faces 160, 162 include the greatest width such that the housing 102 is wider than it is deep. In some examples, the height of the top and bottom minor faces 164, 166 is less than the height of the left and right minor faces 168, 170 such that the housing 102 is taller than it is wide. In alternative examples, the height of the top and bottom minor faces 164, 166 may be greater than the height of the left and right minor faces 168, 170 such that the housing 102 is wider than it is tall.

The luggage article 100 illustrated in FIGS. 1-4 is an upright spinner hard side case but may be any type of luggage, including a soft side spinner case, a container, a backpack, a duffle bag, a purse, or the like. As shown, the luggage article 100 includes a first shell portion 180 and a second shell portion 182 defined by a split line 184. The split line 184 extends along the front and rear major faces 160, 162 as well as along the top and bottom minor faces 164, 166 of the luggage article 100. In one example, the split line 184 extends in a straight line substantially parallel to the left and right minor faces 168, 170. In other examples, the split line 184 may extend in a different manner on any one or more of the faces. For instance, the split line 184 may extend across the rear major face 162, and the top and bottom minor faces 164, 166 in a linear manner, and may extend across the front major face 160 in a non-linear manner. In further examples, the split line may curve (once or multiple times), jog, form a serrated shape, or extend at an angle relative to the left and right minor faces 168, 170 of the luggage article 100.

The first and second shell portions 180, 182, which may be right and left shell portions or halves, respectively, may be sized similarly to each other, or one of the shell portions may be sized to include a larger or smaller internal volume. As shown, each of the first and second shell portions 180, 182 may be defined by one or more panels of the luggage article 100. For example, the first shell portion 180 may be defined by the right side panel 132 and at least portions of the front, rear, top, and bottom panels 110, 112, 120, 122 of the housing 102. In such examples, the second shell portion 182 may be defined by the left side panel 130 and the remaining portions of the front, rear, top, and bottom panels 110, 112, 120, 122 of the housing 102. Each shell may include a perimeter rim 190 at the split line 184. The perimeter rims 190 may abut each other when the luggage article 100 is closed. In some examples, each shell portion 180 or 182 may include an edge piece 196 along its respective perimeter rim 190. The edge pieces 196 may provide a desired aesthetic and/or functional characteristic of the luggage article 100. For instance, the edge pieces 196 may facilitate closing of the luggage article 100, as explained below. The edge pieces 196 may also trim the perimeter rims 190 to conceal sewing lines, and/or any imperfections and provide a clean appearance to, and/or a clean interface between, the first and second shell portions 180, 182.

The luggage article 100 is illustrated as a hard side luggage case, but may be formed from many combinations of hard side and soft side material. For example, the housing 102 may be molded from hard side material, or formed from a combination of hard side material and soft side material (known as "hybrid" construction). In some examples, the housing 102 may be formed entirely from soft side material supported by a frame structure suitably configured to allow for the vertical split line 184 as described herein. The hard side material may be a thermoplastic material (self-reinforced or fiber-reinforced), ABS, polycarbonate, polypropylene, polystyrene, PVC, polyamide, PTFE, or biaxially oriented polypropylene, among others. The soft side material may be nylon, canvas, polyester, leather, PVC, polypropylene, polyethylene, and/or PTFE, among others.

Figure 4:
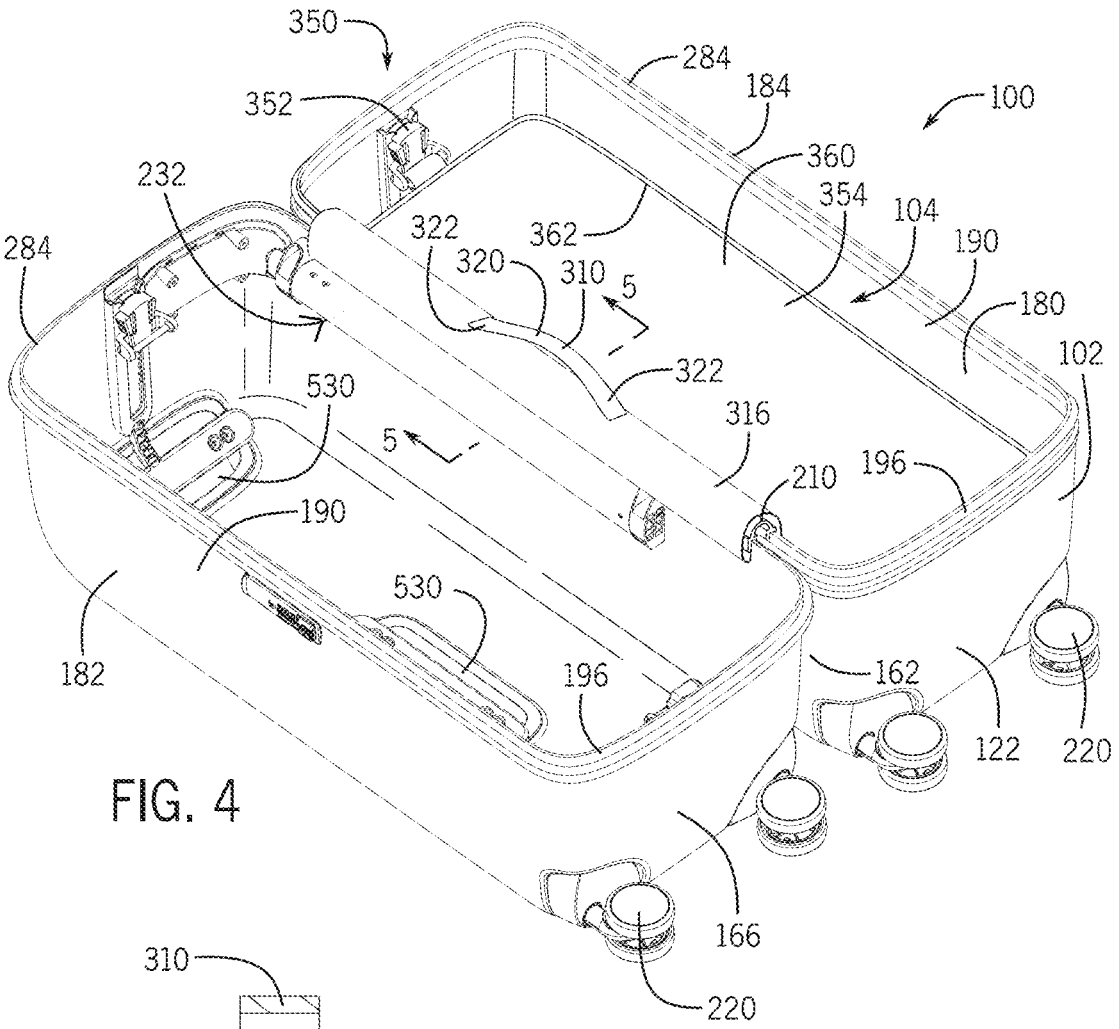
FIG. 4 is an isometric view of the luggage article in an open configuration and showing an internal carry handle and an adjustable divider system.

Referring to at least FIGS. 2 and 4, the luggage article 100 may be moved between a closed configuration (see FIG. 2, showing the rear major face 162 of the luggage article 100) and an open configuration (see FIG. 4). In the closed configuration, the first and second shell portions 180, 182 may be positioned adjacent to each other, and in one example with the respective perimeter rims 190 in engagement, to enclose a user's belongings within the internal storage volume 104 of the luggage article 100. In one example, the respective perimeter rims 190 may each, along at least a portion of the perimeter, have a shape to fit together and form corresponding overlapping or interlocking structures, such as a tongue and groove structure, to enhance the structural performance of the engaged rims 190 when closed. The corresponding shapes may extend along the entire length of the perimeter rims 190, or along a single portion of each rim 190, or along more than one portion of each rim 190.

In the open configuration, the first and second shell portions 180, 182 may be re-oriented relative to each other to allow user access to the interior of the luggage article 100. In one example, the re-orientation of the first and second shell portions 180, 182 positions the respective opening formed by each perimeter rim 190 facing upwardly (in FIG. 4), which allows a user easy access to the relatively large and deep storage volume 104 or each portion 180, 182. To allow selective movement of the first and second shell portions 180, 182 between the open and closed configurations, the first and second shell portions 180, 182 may be pivotably attached together by a hinge 210 or similar mechanism. In such examples, the first and second shell portions 180, 182 may be pivoted about the hinge 210 towards or way from each other to selectively close or open the luggage article 100, respectively. As shown in FIG. 4, when in the open position, the rear major face 162 of the luggage article 100 is split into two sections, and these sections may abut each other to limit the re-orientation of the first and second shell portions 180, 182 relative to one another.

Figure 5:
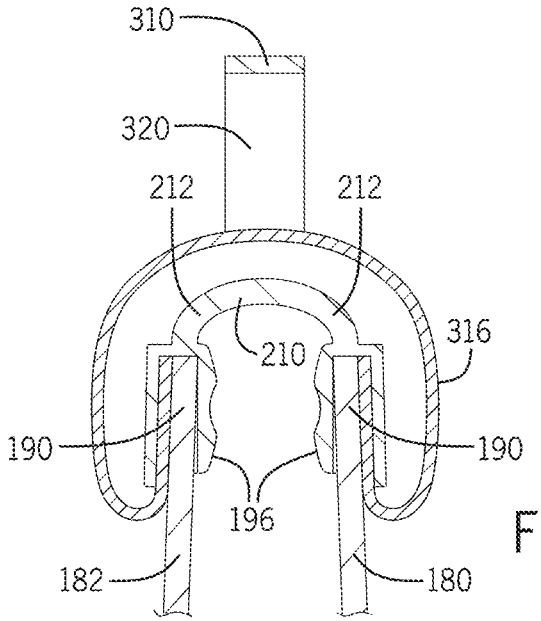
FIG. 5 is a cross-sectional view of the internal carry handle taken along line 5-5 in FIG. 4.

As shown in FIG. 2, the hinge 210 may be defined between the first and second shell portions 180, 182, such as on the rear panel 112, along at least a portion of the split line 184. The hinge 210 may include many configurations arranged to allow selective positioning, such as in one example by rotation about an axis of the hinge 210, of the first shell portion 180 relative to the second shell portion 182 from fully closed to fully open. For example, the hinge 210 may be defined by opposing edges 212 along its length, each edge 212 connected to a respective shell portion of the housing 102. More specifically, one edge 212 of the hinge 210 may be connected to the perimeter rim 190 of the first shell portion 180, and the other opposing edge 212 of the hinge 210 may be connected to the perimeter rim 190 of the second shell portion 182. Each of the opposing edges 212 of the hinge 210 may be connected either directly or indirectly through one or more intermediate elements to a respective perimeter rim 190. For instance, as illustrated in FIG. 5, the opposing edges 212 of the hinge 210 may be connected to the edge pieces 196 extending along the perimeter rims 190 of the first and second shell portions 180, 182. In some examples, the opposing edges 212 may be formed integrally, or at least partially integrally, with the perimeter rims 190 of the first and second shell portions 180, 182. Depending on the particular application, the hinge 210 may include any number or combination of a fabric strip, a strip of rubber, a piano hinge, a living hinge, spaced-apart discrete hinges, a zipper structure, an articulating joint made of elastomeric material, or other suitable structures that allow relative movement between the first and second shell portions 180, 182. Such relative movement may include pure rotation about a fixed pivot axis, or may include rotation about a pivot axis combined with translation or other relative movement.

Referring to FIGS. 1-4, the luggage article 100 may include one or more support members 220 to support the luggage article 100 against a support surface (e.g., against the ground). The support members 220, which may be a foot, a fixed wheel assembly, a spinner wheel assembly, or any combination thereof, may be associated with any suitable panel of the housing 102, such as in at least one example connected to at least the bottom panel 122. As shown, the luggage article 100 may include four support members 220. In such examples, the luggage article 100 may include two support members 220 connected to each of the first shell portion 180 and the second shell portion 182. The luggage article 100 may be tilted by a user onto two of the support members 220 for traversal across a support surface. Due to the placement of the split along the front and rear major faces 160, 162 of the luggage article 100, the luggage article 100 may be traversed across the support surface on only one support member 220 on each of the first and second shell portions 180, 182.

The support members 220 may be connected to any suitable portion of the housing 102, such as at or near the corner regions 140 along the bottom panel 122. For instance, the support members 220 connected to the first shell portion 180 may be connected at or near the corner regions 140 defined by the intersection of the front panel 110, the right side panel 132, and the bottom panel 122 and by the intersection of the rear panel 112, the right side panel 132, and the bottom panel 122. In like manner, the support members 220 connected to the second shell portion 182 may be connected at or near the corner regions 140 defined by the intersection of the front panel 110, the left side panel 130, and the bottom panel 122 and by the intersection of the rear panel 112, the left side panel 130, and the bottom panel 122.

With continued reference to FIGS. 1-4, the luggage article 100 may include a plurality of carry handles 230 and/or a retractable tow handle 232. For example, the luggage article 100 may include one or more top carry handles 240 connected to at least a portion of the top panel 120 of the housing 102. A top carry handle 240 may be located on at least one of the top corners of the housing 102, and may be located on at least two of the top corners of the housing 102. The top corners may, in one example, be opposing top corners. Similarly, the luggage article 100 may include one or more side carry handles 242 connected to each of the side panels of the housing 102. A side carry handle 242 may be located on at least one side of the housing 102. As explained more fully below, the top carry handles 240 and the side carry handles 242 may be positioned to facilitate maneuverability of the luggage article 100 when being carried by a user. For instance, the top carry handles 240 and the side carry handles 242 may be positioned to facilitate carrying of the luggage article 100 around an obstacle, such as up a flight of stairs or the like.

Referring to FIGS. 2 and 3, the tow handle 232 may be movable between a retracted position (see FIG. 2) and an extended position (see FIG. 3). As shown in FIG. 2, in the retracted position, the grip 252 of the tow handle 232 may be positioned near or adjacent to the housing 102, such as being at least partially retracted into or towards the housing 102. Retraction of the tow handle 232 into the retracted position may reduce an overall dimension of the luggage article 100. For instance, the tow handle 232 may be moved to the retracted position to reduce an overall size of the luggage article 100 to facilitate storage and/or positioning of the luggage article 100 in a relatively smaller space. As shown in FIG. 3, in the extended position, the grip 252 of the tow handle 232 may be moved away from the housing 102. Extension of the tow handle 232 into the extended position may allow a user to traverse the luggage article 100 across a support surface as desired. For instance, the user may push, pull, spin, tilt, or otherwise maneuver the luggage article 100 across a support surface through user manipulation of the tow handle 232.

The tow handle 232 may include many configurations facilitating movement of the tow handle 232 between its retracted and extended positions. For instance, the tow handle 232 may include one or more extensible tubes or poles 250 and a grip 252 connected thereto. Each pole 250 may include one or more telescoping tubes to allow the tow handle 232 to extend and retract. In one example, the tow handle 232 includes a single pole configuration. The grip 252, which may be referred to as a grip portion, may extend from a distal end of the pole 250 such that the pole 250 and grip 252 define an L-shape or a T-shape. Notwithstanding, the examples shown in FIGS. 2 and 3 are illustrative only, and the tow handle 232 may include many configurations, such as a dual pole configuration (see FIGS. 10-14) and the like. As shown, the grip 252 may extend substantially parallel to the split line 184. For example, the grip 252 may extend in a manner oriented with the split line 184, such as being co-extensive with or parallel to, or may be spaced from the split line 184 in a parallel relationship thereto. In such examples, the grip 252 may extend at least partially over the top panel 120 of the housing 102.

In one example, the tow handle 232 may be positioned near or at the hinge 210 along the rear panel 112 of the housing 102. For instance, the tow handle 232 may be offset from the hinge 210 into either the first shell portion 180 or the second shell portion 182. Alternatively, the tow handle 232 may be integrated into the hinge 210 and/or at least partially define the hinge's axis, as explained in more detail below.

Depending on the particular application, the tow handle 232 may be aligned along the outside of the rear panel 112 of the luggage article 100. Alternatively, the tow handle 232 may also be aligned along the rear panel 112 but positioned inside the housing 102. In such examples, the tow handle 232 may be secured to the housing 102, such as by mechanical fasteners 258, non-mechanical mechanisms (e.g., adhesive, welding, etc.), or the like.

In some examples, the housing 102 may be configured to accommodate at least portions of the tow handle 232. By way of example, as shown in FIG. 3, a recess 264 may be defined in the housing 102 to at least partially receive the grip 252 of the tow handle 232 when the tow handle 232 is positioned in its retracted position. The recess 264 may be defined in at least the top panel 120 of the housing 102. In some examples, the recess 264 may be defined in a portion of the corner region 140 defined by the intersection of the top panel 120 and the rear panel 112. Additionally or alternatively, the recess 264 may be defined in at least the rear panel 112. Depending on the particular application, the recess 264 may be defined in one of the housing 102 shells, such as in the second shell portion 182. In alternative examples, recessed portions 266 may be defined in both the first shell portion 180 and the second shell portion 182 such that the recessed portions 266 combine to define the recess 264 when the first and second shell portions 180, 182 are connected together (see, e.g., FIGS. 9 and 10). As shown in FIG. 2, the recess 264 may be arranged such that the grip 252 of the tow handle 232 sits within the housing 102 to reduce the possibility of the grip 252 being caught or snagged during shipment or transport. For instance, the grip 252 sits within the recess 264 substantially flush or below flush, or slightly above flush, with the exterior of the housing 102 when the tow handle 232 is positioned in its retracted position.

Referring to FIGS. 1-4, the luggage article 100 may include a closure mechanism 280 to selectively secure the first shell portion 180 and the second shell portion 182 together. The closure mechanism 280 may be positioned along or adjacent to the split line 184 between the first shell portion 180 and the second shell portion 182 to engage each of the shell portions 180, 182 and allow selective actuation for opening and closing of the luggage article 100. The closure mechanism 280 may be a discrete mechanism, such as a latch, or may be a continuous-closure mechanism positioned along at least a part of the length of the split line 184, such as a zipper. In an open configuration, the closure mechanism 280 is disengaged along a length of the split line 184 sufficient to allow the first shell portion 180 and the second shell portion 182 to pivot relative to each other to any amount from partially open to fully open. In one example, where the closure mechanism 280 is a zipper, the closure mechanism 280 is disengaged along the entirety of the front major face 160, the top minor face 164, and the bottom minor face 166, which allows the first and second shell portions 180, 182, to move relative to one another about the hinge 210. In a closed configuration, the closure mechanism 280 is engaged along at least a portion of the length of the split line 184 to limit relative movement between the first shell portion 180 and the second shell portion 182.

The closure mechanism 280 may be any suitable closure device or system. For instance, the closure mechanism 280 may be a zip closure 282 or attachment. In such examples, zipper tape 284 may be connected to the perimeter rim 190 of each of the first shell portion 180 and the second shell portion 182. In some examples, the zipper tape 284 may be connected to the edge pieces 196 extending along the perimeter rims 190 of the first and second shell portions 180, 182. In one example, the closure mechanism 280 may extend along at least three edges of the first shell portion 180 and the second shell portion 182, with the hinge 210 being positioned on a remaining edge of the first and second shell portions 180, 182. Additionally, the closure mechanism 280 may extend a portion of the length of the split line 184 on the remaining edge of the first and second shell portions 180, 182, with the hinge 210 extending along the balance of the length of the split line 184 on the remaining edge. In another example, the closure mechanism 280 may be positioned along at least the edges of the first and second shell portions 180, 182 opposing the hinge 210, such as along the front panel 110.

Figure 7:
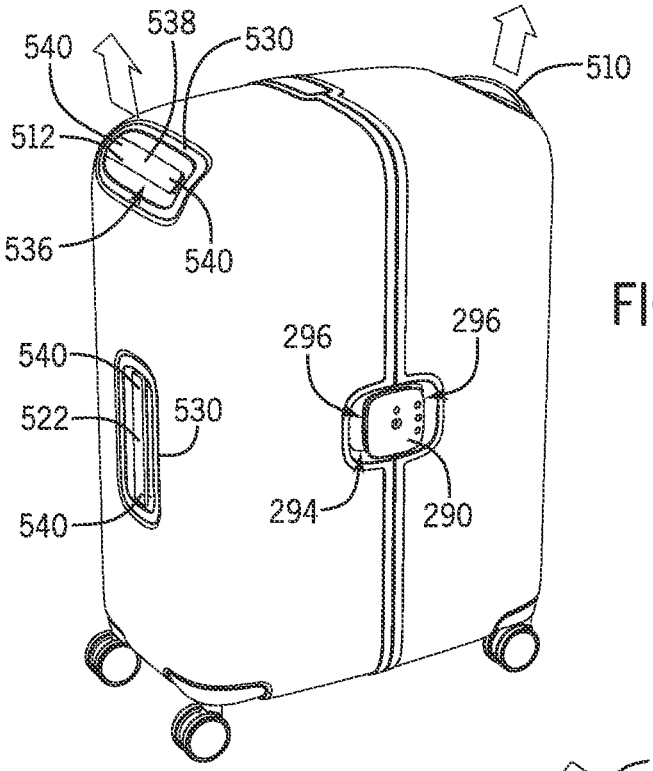
FIG. 7 is an isometric view of an additional luggage article in a first carrying position according to some examples of the present disclosure.
Figure 8:
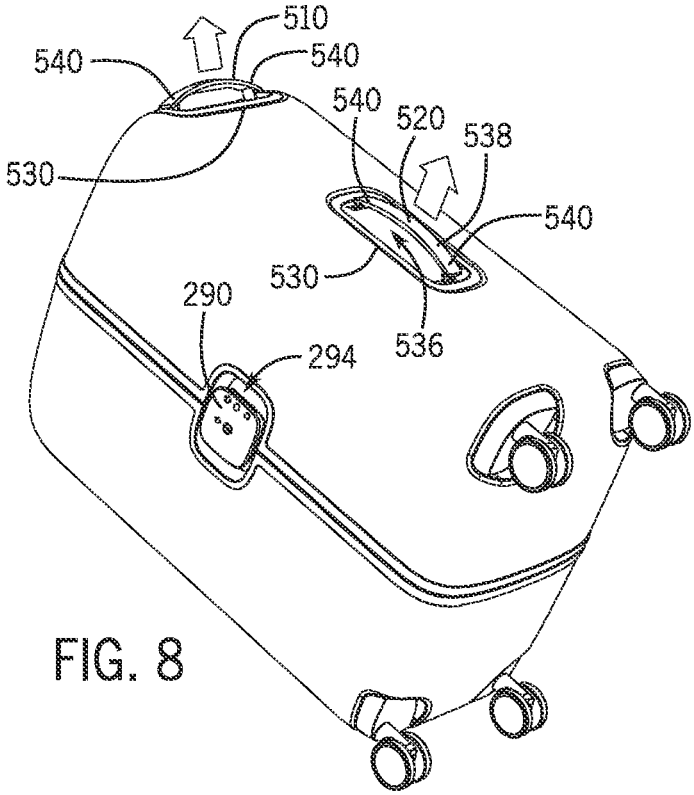
FIG. 8 is another isometric view of the luggage article of FIG. 7 and showing the luggage article in a second carrying position.

Though FIGS. 1-4 illustrate a zip closure 282, other types of closure devices are contemplated. As one example, one or more latches 290 may be spaced along the split line 184 (see FIGS. 7, 8, and 10). As shown in FIGS. 7 and 8, the closure mechanism 280 may include a discrete single latch 290 located in the front major face 160 of the housing 102. In this manner, the closure mechanism 280 may be positioned on the major face opposite the hinge 210. In one such configuration, the latch 290 may be snapped closed under the weight of the luggage article 100. For example, when the luggage article 100 is positioned against a support surface in a partly open configuration, the weight of the luggage article 100 (whether unladen or filled with user belongings) may bias the first and second shell portions 180, 182 to pivot towards each other to latch the first and second shell portions 180, 182 together. More specifically, when a partly open luggage article 100 is positioned against a support surface with its rear panel 112 engaging the support surface, the weight of the luggage article 100 may create a moment arm about the hinge 210 tending to pivot the first and second shell portions 180, 182 towards each other.

In one example, the latch 290 may auto engage once the first and second shell portions 180, 182 engage each other. For instance, the latch 290, which may be fixed to one of the shell portions 180 or 182, may include a hook, such as defined on a leading end of the latch 290. In such examples, the other shell portion 180 or 182 may include a ramp defined thereon. When the first and second shell portions 180, 182 are brought together, the hook of the latch 290 may be secured to the ramp of the opposing shell portion 180 or 182. For example, the hook of the latch 290 may travel up, under, or around the ramp until securing portions of the ramp and hook engage and lock with each other. To release the latch 290, the latch 290 may be lifted by the user to disengage the hook from the ramp. The latch 290 may include other configurations, such as an over-center configuration or a spring detent configuration.

In some examples, the latch 290 may be positioned within a recess 294 defined in the front panel 110 of the housing 102. More specifically, recessed portions 296 may be defined along the split line 184 in both the first and second shell portions 180, 182 such that the recessed portions 296 combine to define the recess 294 when the first and second shell portions 180, 182 are connected together. When the luggage article 100 is closed, the latch 290 may be positioned within the recessed portions 296 of the first and second shell portions 180, 182. When the luggage article 100 is opened, the latch 290 may disengage and be positioned at least partially within the recessed portion 296 of one of the first and second shell portions 180, 182. In such examples, when the luggage article 100 is closed, the latch 290 may extend into the recessed portion 296 of the other of the first and second shell portions 180, 182 to secure the first and second shell portions 180, 182 together. In some examples, portions of the latch 290 may separate from one another when the luggage article 100 is opened, with at least one portion of the latch 290 positioned within the recessed portion 296 of the first shell portion 180 and at least another portion of the latch 290 positioned within the recessed portion 296 of the second shell portion 182. When the luggage article 100 is closed, the portions of the latch 290 may combine to lock the first and second shell portions 180, 182 together. In some examples, the recess 294 may be arranged such that the latch 290 sits generally flush, below flush, or slightly above flush, with the exterior of the housing 102 when the luggage article 100 is positioned in its closed configuration. This helps reduce the risk that the latch 290 is caught or snagged during shipment.

FIG. 4 is an isometric view of the luggage article 100 in an open configuration and showing an internal carry handle. FIG. 5 is a cross-sectional view of the internal carry handle and taken along line 5-5 in FIG. 4. Referring to FIGS. 4 and 5, the luggage article 100 may include an internal carry handle 310 to facilitate user manipulation of the luggage article 100 when it is oriented in an open configuration. For instance, user manipulation of the internal carry handle 310 may allow a user to lift, carry, or otherwise move the luggage article 100 when the luggage article 100 is open. The internal carry handle 310 may allow a user to move the luggage article 100 as desired when positioned in an open configuration, such as moving the luggage article 100 from the ground to an elevated position on top of a bed, table, or other elevated surface, or vice versa. The internal carry handle 310 may facilitate movement of the luggage article 100 when opened without first having to close the luggage article 100. Lifting the open luggage article 100 by the internal carry handle 310 may be accomplished without the luggage article 100 falling further open or collapsing to a closed position, such as happens when a traditional luggage case is moved when in the open configuration. This is accomplished by portions of the rear major face 162 facially abutting one another to limit further rotation (opening) of the first and second shell portions 180, 182 towards each other.

With continued reference to FIGS. 4 and 5, the internal carry handle 310 may allow user manipulation of the luggage article 100 in a comfortable and ergonomic way. For instance, the internal carry handle 310 may be positioned above the center of gravity of the opened luggage article 100. As one example, the internal carry handle 310 may be positioned in the middle of the opened luggage article 100. As best shown in FIG. 5, the internal carry handle 310 may be positioned above a portion of the split line 184 between the first and second shell portions 180, 182. In some examples, the internal carry handle 310 may be positioned above the hinge 210 pivotably connecting the first and second shell portions 180, 182 together. Depending on the particular application, the internal carry handle 310 may be positioned closer to one of the top and bottom panels 120, 122 of the housing 102. In some examples, the internal carry handle 310 may include a plurality of carry handles positioned at different locations along a length of the split line 184 between the first and second shell portions 180, 182. The internal carry handle 310 may extend parallel to the portion of the split 184 over which the handle 310 lies.

The internal carry handle 310 may include many configurations. For example, the internal carry handle 310 may be connected to both the first shell portion 180 and the second shell portion 182. As shown, the internal carry handle 310 may include a base 316. The base 316, which may be a trim piece over the hinge 210, may be connected along a portion of the respective perimeter rims 190 of the first shell portion 180 and the second shell portion 182. In such examples, the base 316 may include a dimension (e.g., a length, width, thickness, etc.) sufficient to allow the luggage article 100 to fully open. In some examples, the base 316 may be sized to define the fully open configuration of the luggage article 100. For instance, the base 316 may be dimensioned such that the base 316 contacts the portions of the first shell portion 180 and the second shell portion 182 positioned therebelow to limit further opening of the first and second shell portions 180, 182. The base 316 may be resilient to allow repeated deformation thereof. For instance, the base 316 may be formed from soft side material, such as nylon, canvas, polyester, leather, PVC, polypropylene, polyethylene, and/or PTFE, among others.

With continued reference to FIGS. 4 and 5, the internal carry handle 310 may include a grip 320 able to be grasped by a user's hand or hands. The grip 320 includes opposing ends 322 defining a length therebetween. In some examples, the opposing ends 322 of the grip 320 may be connected to the base 316. In alternative examples, the opposing ends 322 of the grip 320 may be connected to the housing 102, such as to one or both of the first and second shell portions 180, 182. In such examples, the internal carry handle 310 may be defined by the grip 320 only without any other elements, including the base 316. The examples provided above are for illustration purposes only, and the luggage article 100 may include many configurations with a carry handle positioned within the interior of the housing 102 to allow a user to lift, carry, or otherwise move the luggage article 100 when the luggage article 100 is in a laid open configuration. To allow comfortable and/or ergonomic manipulation of the luggage article 100 via the internal carry handle 310, the grip 320 may be positioned above the center of gravity of the opened luggage article 100, such as above a portion of the split line 184 and/or the hinge 210 between the first and second shell portions 180, 182. In some examples, the length of the grip 320 may be sufficient to allow the grip 320 to be grasped with two hands.

Figure 6:
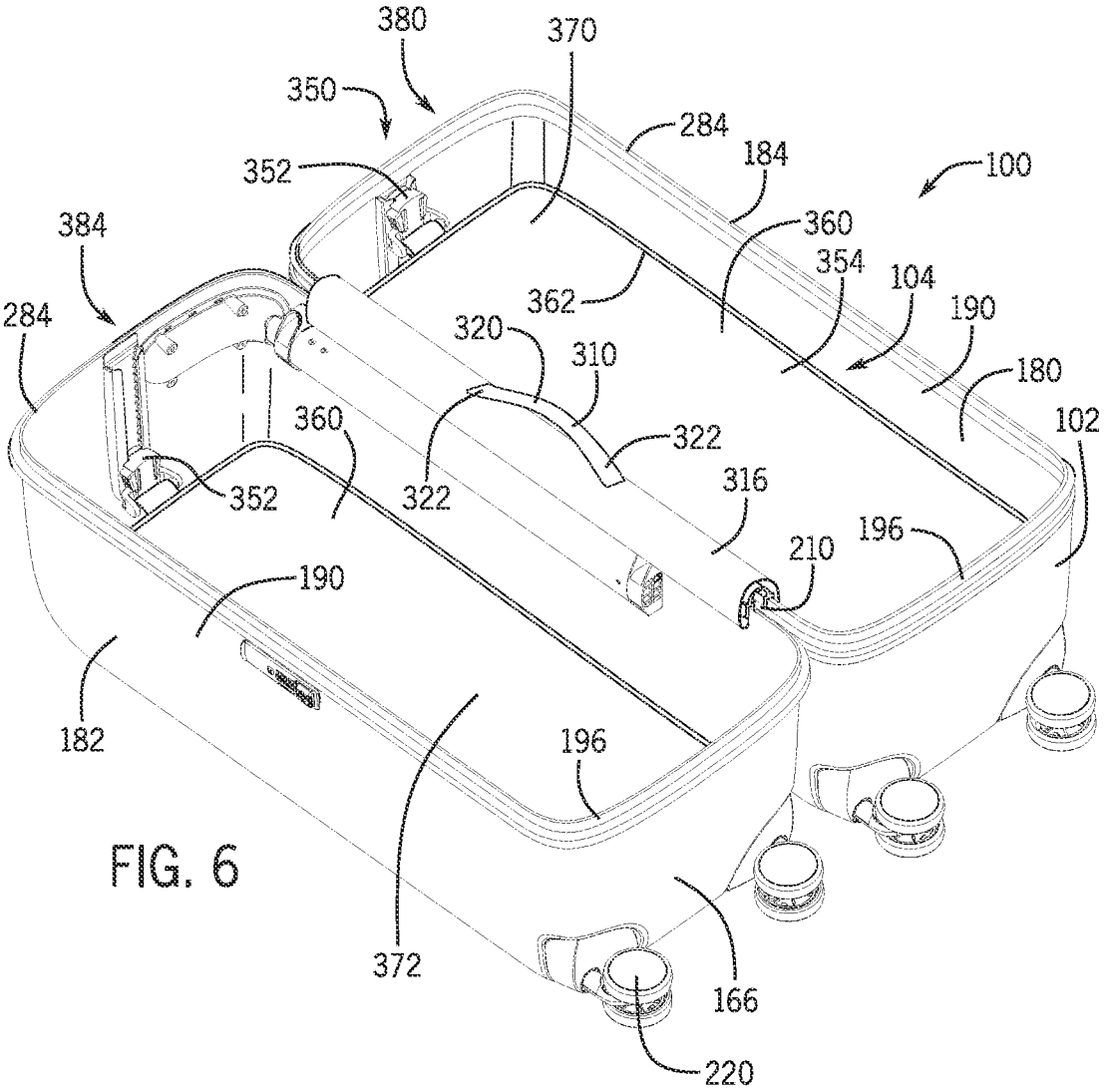
FIG. 6 is another isometric view of the luggage article in an open configuration and showing an adjustable divider system.

FIG. 4 is an isometric view showing, in part, an adjustable divider system that allows a user to adjust a storage volume of one or more shell portions. FIG. 6 is another isometric view showing, in part, the adjustable divider system. Referring to FIGS. 4 and 6, the luggage article 100 may include an adjustable divider system 350. The divider system 350 may include an adjustment assembly 352 and one or more dividers 354. The dividers 354 may divide the internal storage volume 104 into multiple storage compartments. At least one of the first shell portion 180 and the second shell portion 182 may include a divider 354 therein. The divider 354 may include a central section 360 and a perimeter frame 362 providing support and/or structure to the central section 360. For example, the perimeter frame 362, which may be a wire loop frame, may tension the central section 360.

Figure 10:
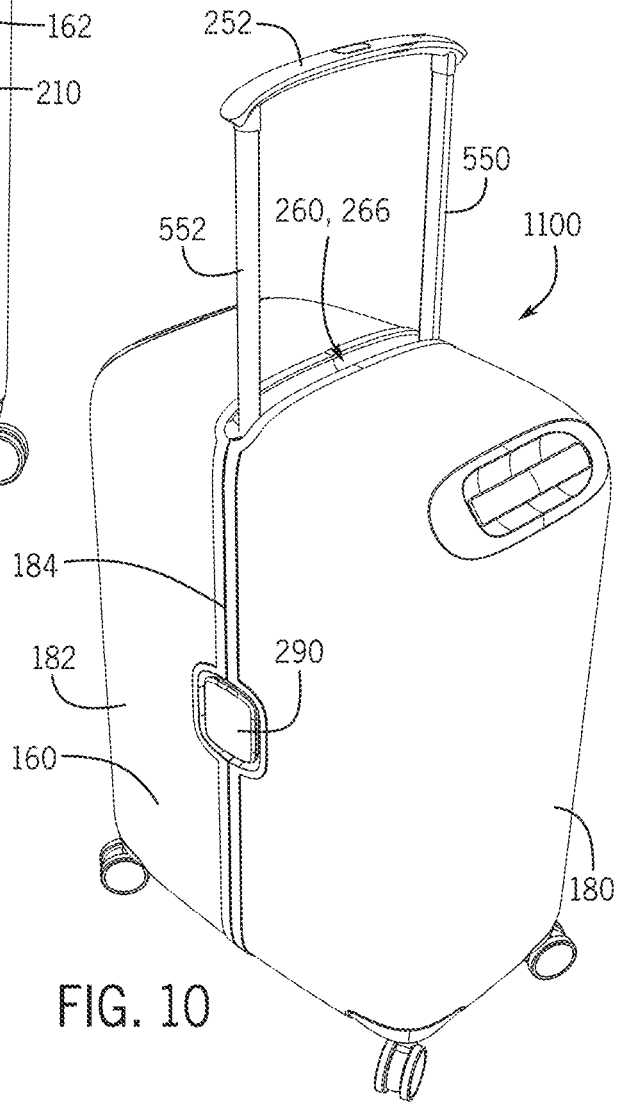
FIG. 10 is a front isometric view of an additional luggage article with a dual pole retractable tow handle bridging between the luggage article's front and rear major faces according to some examples of the present disclosure.

As shown in FIG. 10, the central section 360 may include many configurations, such as defining a laundry bag, a garment bag, a travel organizer, a toiletry bag or organizer, or the like. The divider 354 may also be a panel of relatively rigid material without a separate frame required, and may also include additional soft bag portions secured thereto, forming a laundry bag, garment bag, travel organizer, toiletry bag, or the like. The illustrated examples are non-limiting, and the central section 360 could be mesh and/or a strap or series of straps connected to the perimeter frame 362, among others. Depending on the particular application, the central section 360 may or may not cover the entire area of the shell opening.

In some examples, each of the first shell portion 180 and the second shell portion 182 may include a respective divider 354. For example, as shown in FIG. 6, the luggage article 100 may include a first divider 370 within the first shell portion 180 and a second divider 372 within the second shell portion 182. Depending on the particular application, the first divider 370 may be similar, if not identical, to the second divider 372. In alternative examples, the first divider 370 may be configured differently than the second divider 372 as desired.

With continued reference to FIGS. 4 and 6, each divider 354 may be connected to one or more adjustment assemblies 352. As described herein, each adjustment assembly 352 may allow select movement of a connected divider 354 within the housing 102. In particular, each adjustment assembly 352 may allow the user to move a connected divider 354 within the housing 102 to position the divider 354 as desired. In some examples, each adjustment assembly 352 may allow the user to move a connected divider 354 towards or away from a minor face of the housing 102, such as down to reduce the storage volume under the divider, or up to increase the storage volume under the divider, when the luggage article 100 is open.

As shown in FIG. 6, the first shell portion 180 may include a first plurality of adjustment assemblies 380, with the first divider 370 connected thereto. The first plurality of adjustment assemblies 380 may allow user positioning of the first divider 370 towards (reducing storage volume) or away (increasing storage volume) from the right side panel 132. Such configurations may allow the user to vary a storage volume within the first shell portion 180 as desired. For instance, the user may move the first divider 370 away from the right side panel 132 to increase a storage volume within the first shell portion 180, such as to accommodate packing of a relatively larger amount of user belongings. In like manner, the user may move the first divider 370 towards the right side panel 132 to decrease a storage volume within the first shell portion 180, such as to accommodate packing of a relatively small amount of user belongings. Additionally or alternatively, the user may move the first divider 370 towards the right side panel 132 to tension the first divider 370 against the user belongings positioned between the first divider 370 and the right side panel 132, which may be beneficial to limit shifting of the user belongings during transport, for instance.

The second shell 182 may be configured similarly to the first shell portion 180. In particular, the second shell portion 182 may include a second plurality of adjustment assemblies 384, with the second divider 372 connected thereto. The second plurality of adjustment assemblies 384 may allow user positioning of the second divider 372 towards or away from the left side panel 130. Such configurations may allow the user to vary a storage volume within the second shell portion 182 as desired. For instance, the user may move the second divider 372 away from the left side panel 130 to increase a storage volume within the second shell portion 182, such as to accommodate packing of a relatively larger amount of user belongings. In like manner, the user may move the second divider 372 towards the left side panel 130 to decrease a storage volume within the second shell portion 182, such as to accommodate packing of a relatively small amount of user belongings. Additionally or alternatively, the user may move the second divider 372 towards the left side panel 130 to tension the second divider 372 against the user belongings positioned between the second divider 372 and the left side panel 130.

Unlike traditional luggage cases, the configurations of the present disclosure allow the dividers 354 to move laterally toward the side panels of the housing 102 (as opposed to longitudinally toward the major faces) and relative to the width W of the luggage article 100 when in the closed and upright position. This provides the user the ability to distribute the weight of the user's belongings along the long dimension (width W) of an upright luggage case, as opposed to only front and back. Such configurations allow the luggage article 100 to be more stable and less likely to tip over frontwards or backwards.

FIG. 7 is an isometric view of the luggage article 100 in a first carrying position. FIG. 8 is an isometric view of the luggage article 100 in a second carrying position. Referring to FIGS. 7 and 8, the carry handles 230 may be positioned to facilitate maneuverability of the luggage article 100. As shown, the luggage article 100 may include a pair of top carry handles 240 and a pair of side carry handles 242. More specifically, the luggage article 100 may include a first top carry handle 510 positioned at or near the first upper corner region 142, and a second top carry handle 512 positioned at or near the second upper corner region 144. As shown, the first and second top carry handles 510, 512 may extend between the front panel 110 and the rear panel 112, such as parallel to the depth D of the housing 102. Depending on the particular application, the first and second top carry handles 510, 512 may extend the entire depth D of the housing 102, such as extending up to both the front and rear panels 110, 112 of the housing 102. While the carry handles 510, 512 may include a grip portion having a length that extends the entire depth D of the housing 102, the length of the grip may be shorter and not extend the entire depth D of the housing 102

With continued reference to FIGS. 7 and 8, the luggage article 100 may include a first side carry handle 520 positioned on the right side panel 132 and a second side carry handle 522 positioned on the left side panel 130 of the housing 102. As shown, the first and second side carry handles 520, 522 may extend lengthwise in a direction between the top panel 120 and the bottom panel 122, such as parallel to the height H of the housing 102. In this manner, the first and second side carry handles 520, 522 may extend perpendicularly to the first and second top carry handles 510, 512. As described herein, "perpendicularly" means between 75 and 90 degrees, about 90 degrees, or between 90 and 105 degrees relative to each other. In some examples, the first and second side carry handles 520, 522, or either one of the carry handles 520, 522, may be positioned along the vertical centerline of the housing 102 between the front and rear panels 110, 112. For example, the first and second side carry handles 520, 522, or either one of the carry handles 520, 522, may be spaced equidistantly from the front and rear panels 110, 112 of the housing 102. Additionally or alternatively, the first and second side carry handles 520, 522, or either one of the carry handles 520, 522, may be centered between the top and bottom panels 120, 122 of the housing 102.

The top carry handles 240 and the side carry handles 242 may be configured similarly to one another. For instance, each carry handle 230 may be positioned at least partially within a casing 530 connected to the housing 102 of the luggage article 100. Each casing 530 may include a portion forming a recess to define a cavity 536, which may be referred to as a recess, therein in which to receive a respective carry handle 230 and create space for a user's fingers when the carry handle 230 is extended. In this manner, the carry handles 230 may sit substantially flush or below flush, or slightly above flush, with the exterior of the housing 102, such as to avoid scratches, snagging, etc. The casing 530 is mounted to the housing 102 at the locations where the handles 230 are to be placed. As shown, each carry handle 230 includes a grip portion 538 with opposing ends 540 connected to the casing 530. Depending on the particular application, the opposing ends 540 may be fixed to the casing 530. In some examples, the opposing ends 540 may be movably connected to the casing 530. In some examples, the carry handle 230 may be movable relative to the casing 530 to vary the space between the carry handle 230 and the casing 530. For example, the opposing ends 540 may slide relative to the casing 530 to create sufficient space to allow a user to grasp the carry handle 230. In some examples, each carry handle 230 may be biased to move towards a respective casing 530 when not in use. The examples above are for illustration purposes only, and the carry handles 230 may include other configurations. For example, the carry handles 230 may not have casings 530 or cavities 536. The carry handles 230 may be surface mounted, may be flip-up type handles, may be a mixed type handle, etc.

Continuing to refer to FIGS. 7 and 8, the first and second top carry handles 510, 512 and the first and second side carry handles 520, 522 may be positioned to facilitate carrying of the luggage article 100 relative to certain obstacles. For example, as shown in FIG. 7, placement of the first and second top carry handles 510, 512 may allow a user to lift and/or carry the luggage article 100 using both hands in a better biomechanical position compared to previous designs, such as a single handle positioned centrally on the top panel of the luggage case. Specifically, the first and second top carry handles 510, 512 may be positioned to limit crossing of a user's arm in front of his/her torso, thereby increasing a biomechanical advantage, as well as the ease of gripping the handles, in lifting the luggage article 100 from the top panel 120. Also, when using the first and second top carry handles 510, 512 together, the weight of the luggage article 100 is split between two arms of the user, rather than the entire load being on one arm typical in previous designs, such as a single handle positioned centrally on the top panel of the luggage case.

Referring to FIG. 8, placement of the top carry handles 240 relative to the side carry handles 242 may facilitate carrying of the luggage article 100 up one or more stairs or steps. In particular, when the luggage case is lifted from the first top carry handle 510 and the first side carry handle 520, the luggage article 100 is tilted at an angle to allow the luggage article 100 to clear, or nearly clear, the stairs or steps up which the luggage article 100 is being carried. More specifically, lifting the luggage article 100 from the first top carry handle 510 and the first side carry handle 520 may tilt the luggage article 100 to an angle closely matching the angle of the stairs or steps. This is due at least in part to the top of the luggage article 100 being oriented in the direction of motion and up the stairs or steps from the wheels when the luggage article 100 is lifted from the first top carry handle 510 and the first side carry handle 520.

In this manner, the top of the luggage article 100 (e.g., the top panel 120, an upper portion of the housing 102, etc.) may be angled to clear, or nearly clear, any upcoming stairs or steps while also allowing the bottom of the luggage article 100 (e.g., the bottom panel 122, a bottom portion of the housing 102, the support members 220, etc.) to clear, or nearly clear, any previous stairs or steps. Lifting the luggage article 100 from the second top carry handle 512 and the second side carry handle 522 may tilt the luggage article 100 similarly. In some examples, lifting the luggage article 100 from the second top carry handle 512 and the second side carry handle 522 may tilt the luggage article 100 differently to accommodate a different stair or step angle, such as a steeper or shallower stair or step angle. As described herein, "closely matching" means within 0 to 10 degrees of the stair or step angle, within 20 degrees of the stair or step angle, or within 30 degrees of the stair or step angle.

Figure 9:
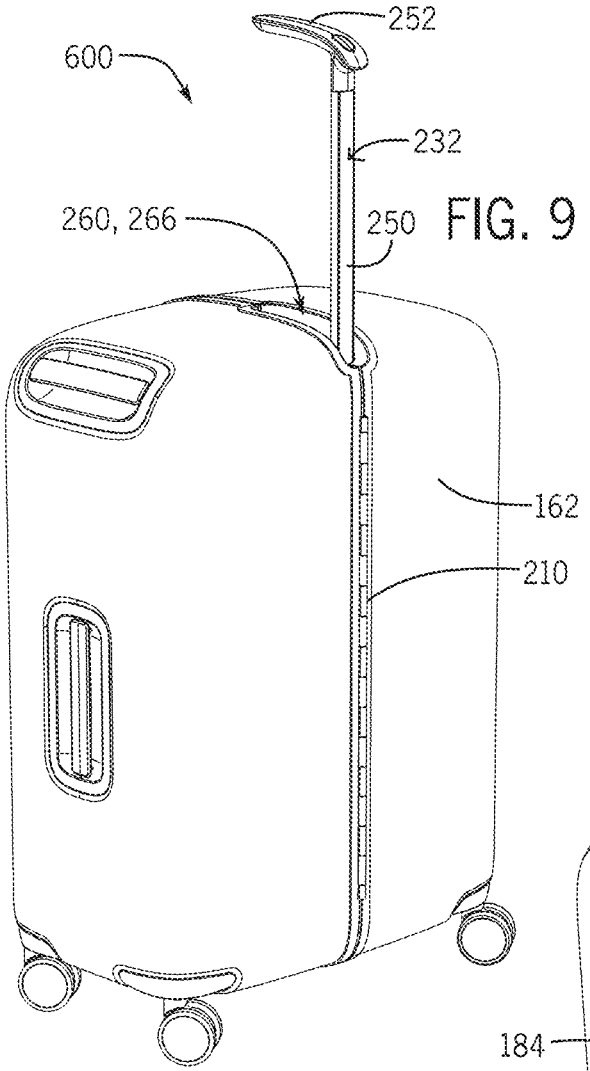
FIG. 9 is a rear isometric view of an additional luggage article with a single pole retractable tow handle integrated near a hinge according to some examples of the present disclosure.
Figure 11:
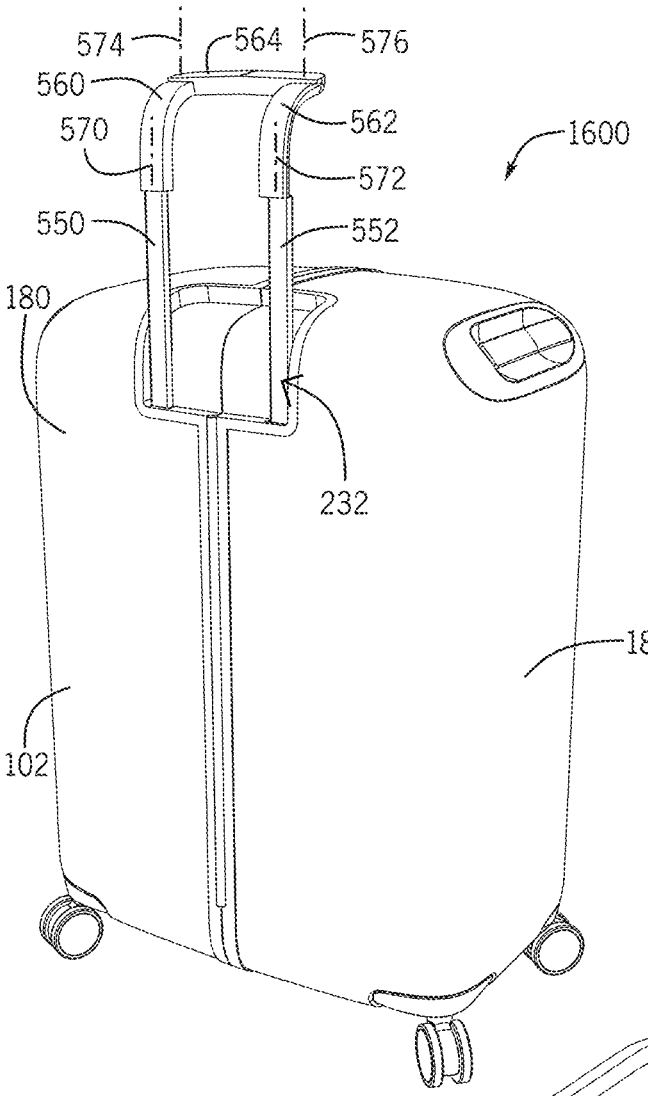
FIG. 11 is a rear isometric view of an additional luggage article with a dual pole retractable tow handle with a hinging handle according to some examples of the present disclosure.
Figure 12:
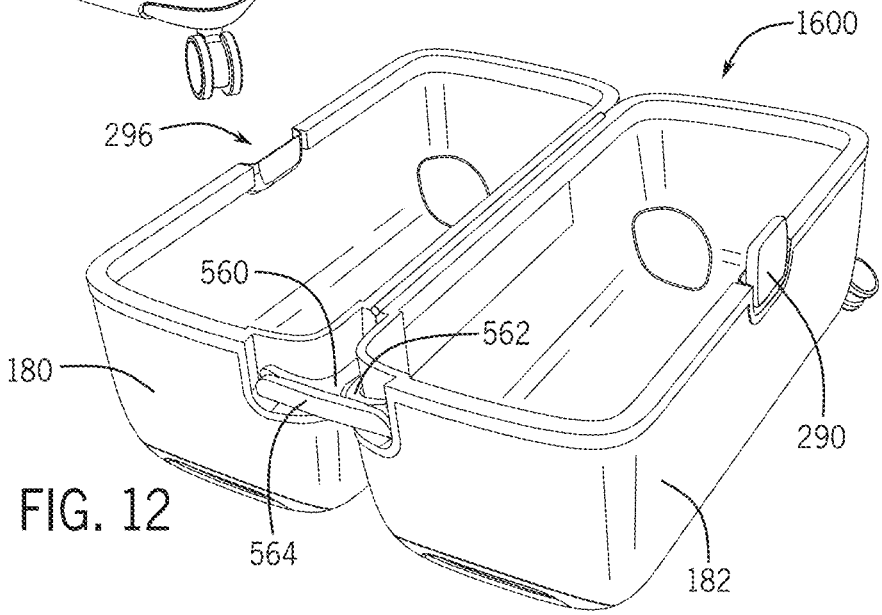
FIG. 12 is an isometric view of the luggage article of FIG. 11 in an open configuration.
Figure 13:
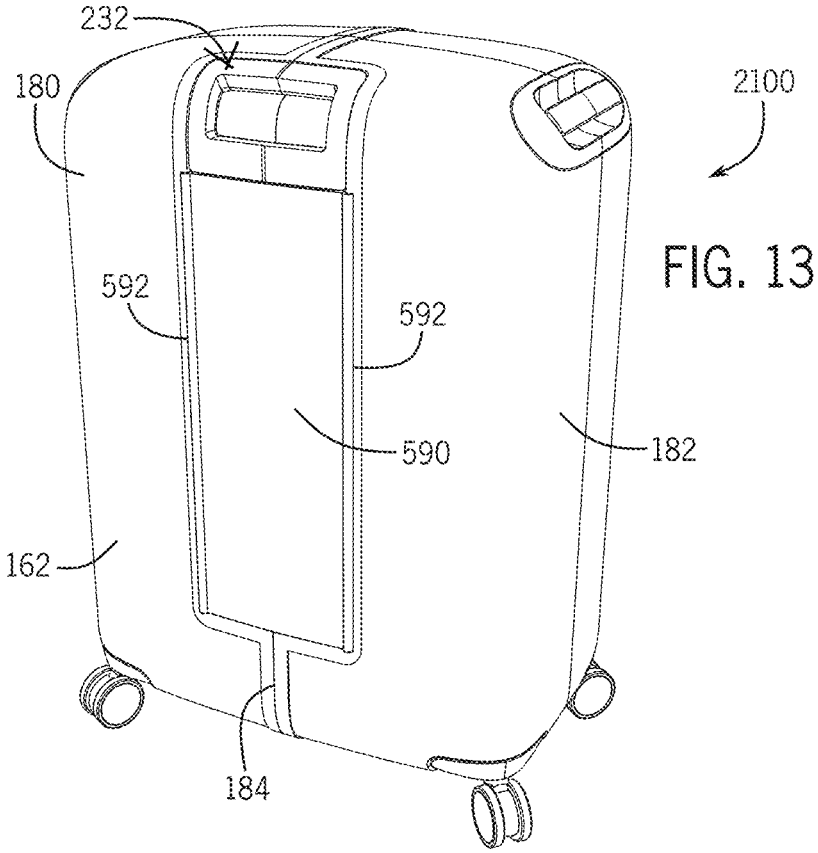
FIG. 13 is a rear isometric view of an additional luggage article with a retractable tow handle integrated with a panel hingedly connecting first and second luggage shells together according to some examples of the present disclosure.
Figure 14:
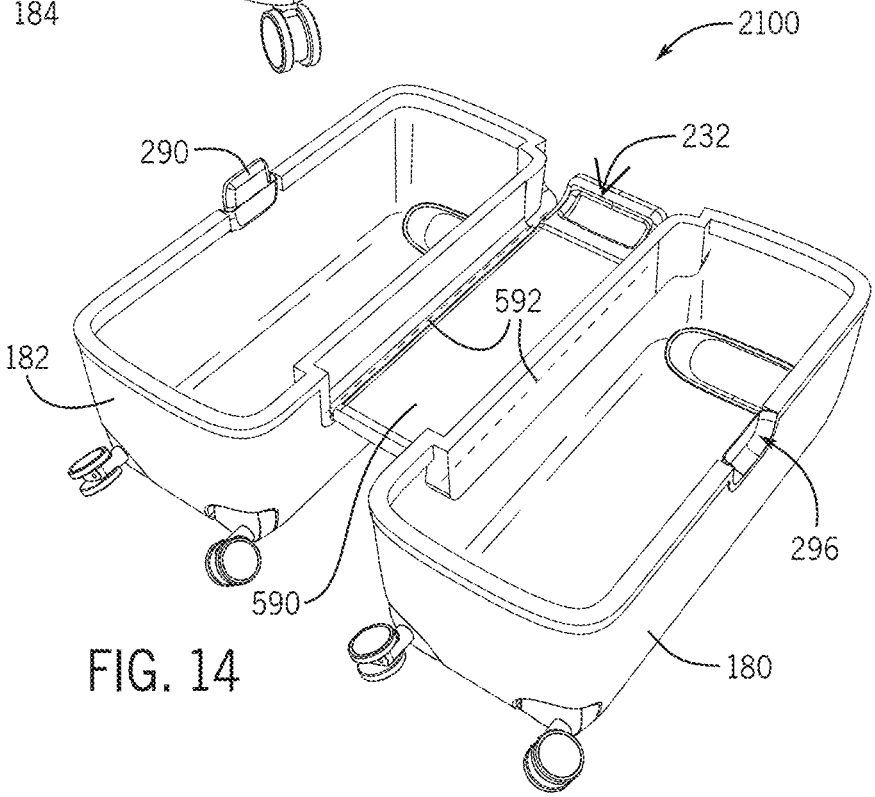
FIG. 14 is an isometric view of the luggage article of FIG. 13 in an open configuration.

FIG. 9 is an isometric view of an additional luggage article 600 with a single tube tow handle integrated near the hinge. FIG. 10 is an isometric view of an additional luggage article 1100 with a dual tube tow handle with the tubes spaced apart in a direction extending between front and rear major faces. FIG. 11 is an isometric view of an additional luggage article 1600 with a hinging dual tube tow handle. FIG. 12 is an isometric view of the luggage article of FIG. 11 in an open configuration. FIG. 13 is an isometric view of an additional luggage article 2100 with a dual tube tow handle integrated with a separate panel hingedly connecting the first and second luggage shells together. FIG. 14 is an isometric view of the luggage article of FIG. 21 in an open configuration. Referring to FIGS. 9-14, the luggage articles 600, 1100, 1600, 2100 may include many configurations of the tow handle positioned on the luggage case in different locations relative to the hinge structure, and with each configuration allowing selective positioning of the first shell portion 180 relative to the second shell portion 182. Except as otherwise described below, the luggage articles 600, 1100, 1600, 2100 shown in FIGS. 9-14 may be similar to the luggage article 100 described above. As such, descriptions of like features are not repeated here, as they would be apparent to one skilled in the art in light of the description above. In addition, the features described below with reference to luggage articles 600, 1100, 1600, or 2100 may be incorporated into the luggage article 100 individually or in any combination.

Referring to FIG. 9, at least a portion of the tow handle 232 may be integrated in the luggage article 600 at a location near the hinge 210. For instance, one of the extensible tube or poles 250 of the tow handle 232 may be positioned relative to the hinge 210 such that the pole 250 extends coextensively with, along, or closely proximate to the pivot axis, and in some examples may define the pivot axis. For example, the hinge 210 may be formed so as to incorporate the pole 250 along the pivot axis. In such examples, the first and second shell portions 180, 182 may pivot about one or more poles 250 (for example, where the tow handle 232 is made up of telescoping tubes to allow the tow handle 232 to extend and retract) of the tow handle 232. For instance, the pole 250 may define a hinge pin about which the first and second shell portions 180, 182 pivot. In some examples, at least a portion of the hinge 210 may be connected to the tow handle 232, with the first and second shell portions 180, 182 pivotably connected thereto. In some examples, the pole 250 of the tow handle 232 may be positioned closely adjacent to the hinge 210, such as inset from the hinge 210. As described herein, "inset" means inset towards the center of the luggage article 100 or inset laterally along the direction of the rear major face 162, such as small amount along the rear major face 162. In some examples, the pole 250 of the tow handle 232 may be inset sufficiently such that the pole 250 and hinge 210 do not interfere with the operation of each other. In one example, the tow handle 232 may be positioned at least partially at the split line 184. In one example, the split line 184 may bisect the tow handle 232, including the one or more extensible poles 250 and the grip 252 of the tow handle 232.

Referring to FIG. 10, the tow handle 232 may extend between the front major face 160 and the rear major face 162 of the luggage article. For example, the tow handle 232 may include a dual tube configuration with a first extensible pole 550 positioned adjacent to the split line 184 along the rear major face 162 and a second extensible pole 552 positioned adjacent to the split line 184 along the front major face 160, where the space between the poles 550 and 552 extends in the direction of the depth D of the luggage article 1100. In such examples, the grip 252 of the tow handle 232 may extend between the front major face 160 and the rear major face 162 of the luggage article along a portion of the split line 184. In this example, the grip 252 extends coextensively with the split line 184, but may be offset to one side or the other, or in non-alignment, in other examples. As shown, the recess 264 may be defined in the top panel 120 between the front and rear panels 110, 112 to at least partially receive the grip 252 spanning the depth D of the housing 102. As noted above, recessed portions 266 may be defined in both the first shell portion 180 and the second shell portion 182, the recessed portions 266 combining to define the recess 264 in which the grip 252 is received. Depending on the particular application, the recessed portions 266 may be formed in the housing 102 itself, or may be formed by separate casings connected to the housing 102.

Referring to FIGS. 11 and 12, the tow handle 232 may include dual tubes connected to a grip 252, where the grip 252 is an assembly comprising several links or parts pivotally connected together in a manner to facilitate selective movement of the first shell portion 180 relative to the second shell portion 182. For example, the tow handle 232 may include a dual tube configuration with tubes positioned to span the split line 184 formed along the rear major face 162 of the housing 102. As shown in FIG. 11, the tow handle 232 includes a first extensible pole 550 connected to the first shell portion 180, a second extensible pole 552 connected to the second shell portion 182, and a grip 252 connecting the first and second poles 550, 552. The grip 252 may include a first part 560 connected to the first pole 550, a second part 562 connected to the second pole 552, and a third part 564 connected to the first and second parts 560, 562. As shown, the first and second parts 560, 562 may be shaped to position the third part 564 (e.g., the hand grip) of the grip 252 away from the rear major face 162, and towards the top panel 120, of the housing 102. For instance, each of the first and second parts 560, 562 of the grip 252 may include an arcuate shape positioning the third part 564 away from the rear major face 162. In such examples, the arcuate shape may closely match the exterior shape of the housing 102 such that the grip 252 sits substantially flush or below flush, or slightly above flush, with the exterior of the housing 102 when the tow handle 232 is positioned in its retracted position. As noted above, recessed portions 266 may be defined in both the first shell portion 180 and the second shell portion 182, the recessed portions 266 combining to define the recess 264 in which the grip 252 is received.

To allow selective movement of the first shell portion 180 relative to the second shell portion 182, the tow handle 232 may include a plurality of movable joints, such as hinges or pivot pins or the like, allowing pivoting movement of the grip 252 relative to the first and second poles 550, 552. For instance, the first part 560 of the grip 252 may be pivotably connected to the first pole 550 at a first hinge 570. Similarly, the second part 562 of the grip 252 may be pivotably connected to the second pole 552 at a second hinge 572. The third part 564 of the grip 252 may be pivotably connected to the first and second parts 560, 562 of the grip 252 at third and fourth hinges 574, 576*s*, respectively. In this manner, the tow handle 232 may include a first pair of hinges in line with the first and second poles 550, 552 and a second pair of hinges on the corners of the grip 252. Each of the first, second, third, and fourth hinges 570, 572, 574, 576*s* may include a hinge axis extending parallel to the pivot axis of the hinge 210 between the first and second shell portions 180, 182.

As shown in FIG. 12, the grip 252 of the tow handle 232 may pivot along the plurality of hinges in each of the two tubes 550, 552 to allow the luggage article to articulate about the hinge 210 between the open and closed configurations. For instance, moving the first shell portion 180 and the second shell portion 182 of the luggage article 1600 between open and closed configurations may rotate the first and second parts 560, 562 of the grip 252 relative to the first and second poles 550, 552 and about the first and second hinges 570, 572, respectively. Additionally or alternatively, moving the luggage article between open and closed configurations may rotate the first and second parts 560, 562 of the grip 252 relative to the third part 564 and about the third and fourth hinges 574, 576, respectively. Depending on the particular application, movement of the luggage article to the open configuration may rotate the first and second parts 560, 562 of the grip 252 towards the third part 564. In such examples, movement of the luggage article to the closed configuration may rotate the first and second parts 560, 562 of the grip 252 away from the third part 564.

Referring to FIG. 11, when the luggage article 1600 is in a closed configuration, the first part 560 of the grip 252 may abut and extend rearwardly away from the third part 564. Similarly, the second part 562 of the grip 252 may abut and extend rearwardly away from the third part 564. In one example, the first and second parts 560, 562 may extend parallel to each other, or nearly parallel to each other. In some examples, the first part 560 may extend parallel to the first pole 550. In like manner, the second part 562 may extend parallel to the second pole 552.

Referring now to FIG. 12, when the luggage article 1600 is in a closed configuration, the first and second parts 560, 562 may be rotated relative to the third part 564 to effectively collapse the space between the first and second poles 550, 552. For example, movement of the first and second shell portions 180, 182 to the open configuration may rotate the first and second parts 560, 562 towards each other to position the first and second parts 560, 562 at least partially in alignment with the third part 564. In one example, the first and second parts 560, 562 may abut or extend closely adjacent to each other when the luggage article 1600 is in a closed configuration. Such change in relative orientation between the first, second, and third parts 560, 562, 562 of the grip 252 may bring the grip 252 closer to being in plane with an extension of the first and second poles 550, 552 when the luggage article 1600 is opened.

Referring to FIGS. 13 and 14, the tow handle 232 may be connected to a separate panel 590, which is in turn connected to the first and second shell portions 180, 182 of the housing 102. In such examples, the panel 590, which may be referred to as an intermediate panel, may define opposing lateral edges that are pivotably connected to the adjacent one of the first and second shell portions 180, 182. In particular, the luggage article may include a hinge 592 on each of the opposing edges of the panel 590 to hingedly connect the panel 590 to both the first and second shell portions 180, 182. As shown, the panel 590 may be hingedly connected to the first shell portion 180 at a position along the rear major face 162 between the split line 184 and the right minor face 170. In like manner, the panel 590 may be hingedly connected to the second shell portion 182 at a position along the rear major face 162 between the split line 184 and the left minor face 168. In such examples, and as best shown in FIG. 14, the panel 590 may space the first and second shell portions 180, 182 away from each other when the luggage article is moved to its open configuration. As used herein, the term "hingedly" includes allowing for relative motion between shell portions attached or coupled together by a hinge structure, such as rotating and/or pivoting relative to one another.

The panel 590 may include many configurations. In one example, the panel 590 is long and narrow. The panel 590 may extend in the direction of the split line 184. As shown, the panel 590 overlies the split line 184 where the first and second shell portions 180, 182 engage along their perimeter rims 190 as noted above. In some examples, the panel 590 is positioned in a recess formed in the housing 102, in particular in each of the first and second shell portions 180, 182. Depending on the particular application, the panel 590 may sit substantially flush with the exterior of the housing 102 when the first and second shell portions 180, 182 are connected together to define the closed configuration of the luggage article 100.

The spacing of the first and second shell portions 180, 182 away from each other may be defined by the width of the panel 590, which is in turn defined by the width of the tow handle 232. For instance, in examples with a dual tube configuration, the spacing between the first and second shell portions 180, 182 when the luggage article is moved to its open configuration may be defined by the distance between the first and second extensible poles 550, 552 of the tow handle 232. In some examples, the spacing may be defined by the width of the tow handle's grip 252, which may or may not correspond to the distance between the first and second extensible poles 550, 552, if equipped. Though the tow handle 232 is shown to include a dual tube configuration, the luggage article may include a single tube tow handle 232 integrated with the panel 590. In such examples, the panel 590 may be reduced in size, which may also position the first and second shell portions 180, 182 closer together when the luggage article is moved to its open configuration.

Figure 15:
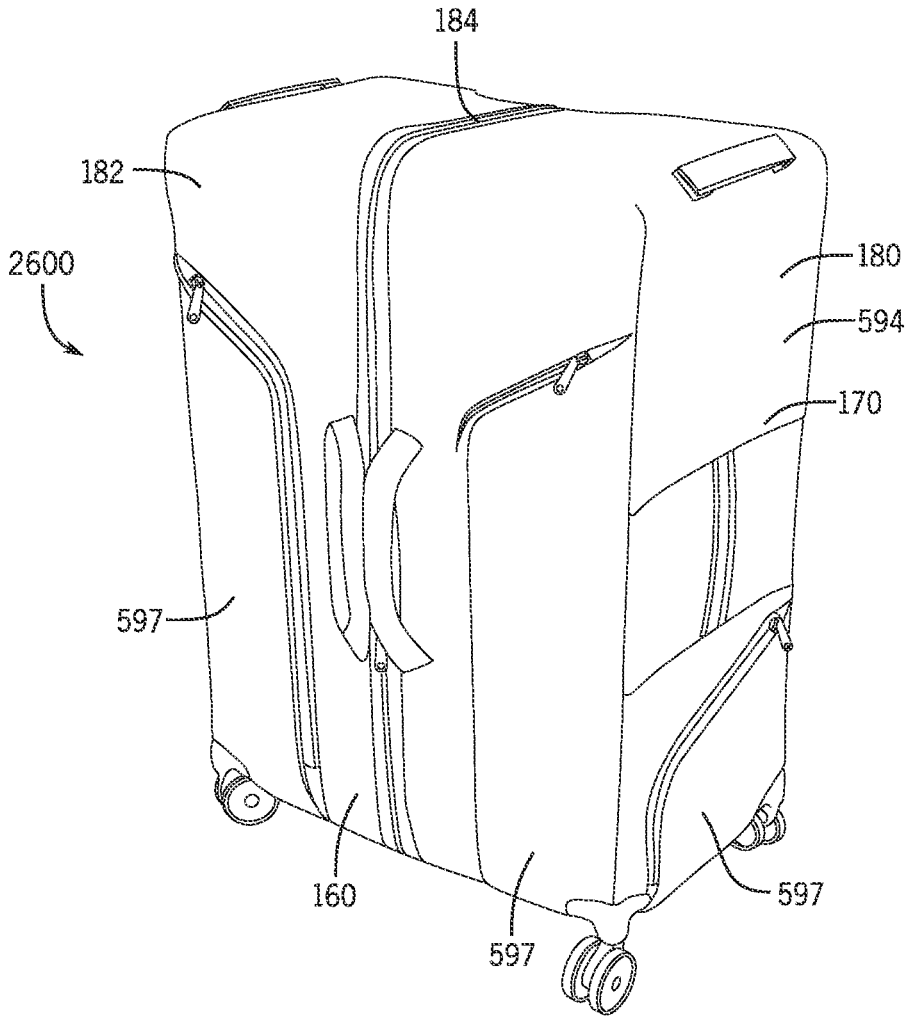
FIG. 15 is a front isometric view of an additional luggage article according to some examples of the present disclosure.
Figure 16:
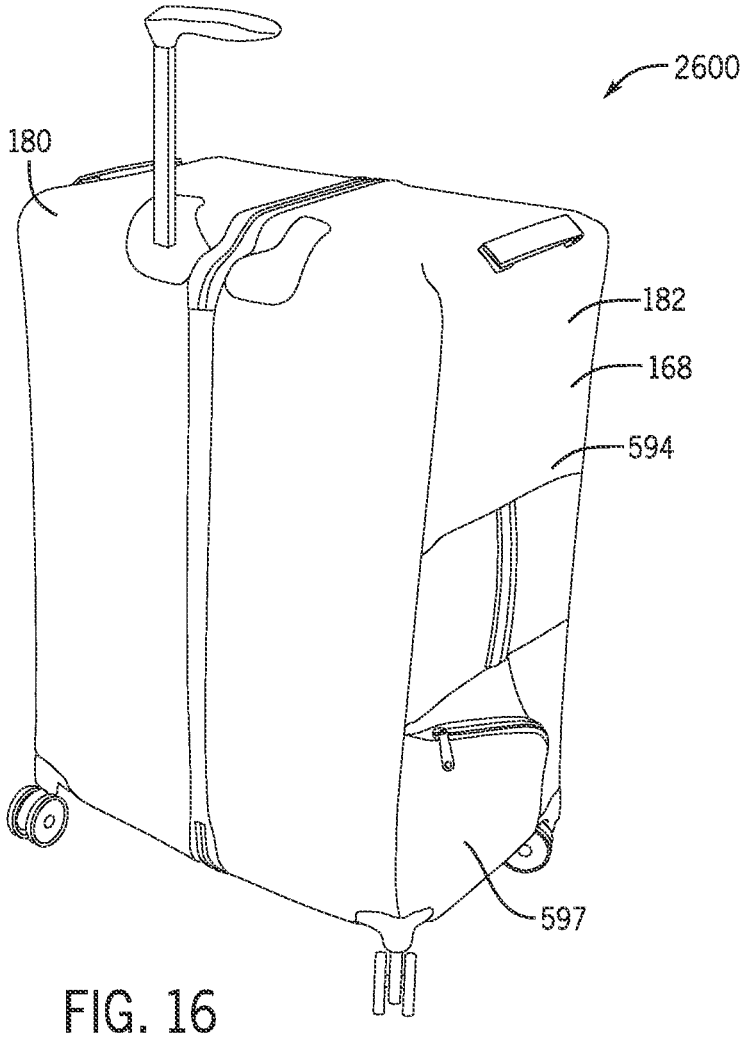
FIG. 16 is a rear isometric view of the luggage article of FIG. 15.
Figure 17:
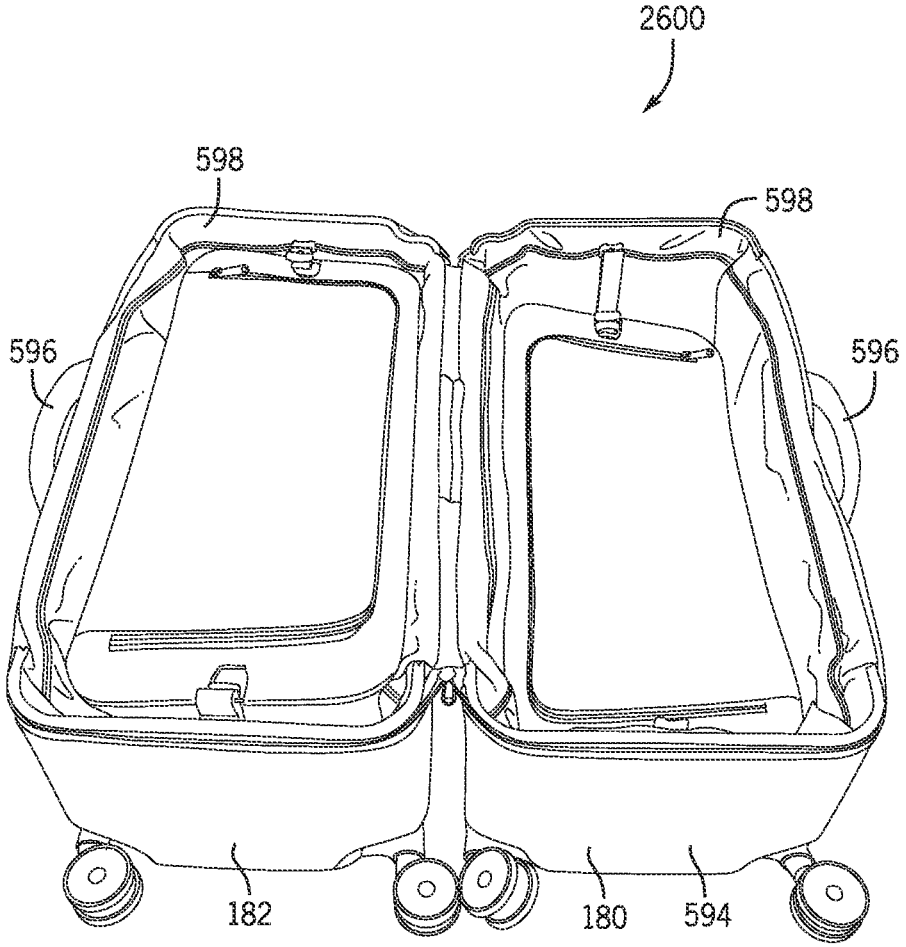
FIG. 17 is an isometric view of the luggage article of FIG. 15 in an open configuration.

FIGS. 15-17 illustrate an additional luggage article 2600. Except as otherwise described below, the luggage article 2600 shown in FIGS. 15-17 may be similar to the luggage articles 100, 600, 1100, 1600, 2100 described above. As such, descriptions of like features are not repeated here, as they would be apparent to one skilled in the art in light of the description above. Additionally, the features described below with reference to luggage article 2600 may be incorporated into the luggage articles 100, 600, 1100, 1600, 2100 described above.

Referring to FIGS. 15-17, the luggage article 2600 may be an upright soft side spinner case with a fabric cover 594 supported by a frame structure suitably configured to allow for the vertical split line 184 described above. The frame structure may include a variety of structural elements coupled together, such as wire hoops, elongate rods, pulltrusions, or pan structures, connected together. The rods, pulltrusions, and pan structures may form one or more frameworks structurally supporting the cover 594 and providing shape to the housing 102.

As shown, the luggage article 2600 may include one or more front carry handles 596 connected to the front major face 160 of the housing 102. In one example, the luggage article 2600 includes a pair of front carry handles 596 connected to the first and second shell portions 180, 182. The front carry handles 596 may be connected to the first and second shell portions 180, 182 at or adjacent to the split line 184. Referring to FIG. 15, when the luggage article 2600 is in the closed configuration, the front carry handles 596 may be positioned closely proximate to each other such that both front carry handles 596 may be grasped together by a single hand of a user. In some examples, the front carry handles 596 may be positioned centrally on the front major face 160 of the housing 102.

Referring to FIGS. 15-17, the luggage article 2600 may include other features for convenience. For instance, as shown in FIGS. 15 and 16, the luggage article 2600 may include one or more exterior pockets 597, such as defined on the front major face 160, the left minor face 168, and/or the right minor face 170. In one example, each of the first and second shell portions 180, 182 may include a plurality of exterior pockets 597. As shown in FIG. 17, the luggage article 2600 may include an inner fabric lining 598. The inner lining 598 may be removable from or fixed to the housing 102.

The luggage article 100 or 2600 may be formed from a variety of materials and means. For example, the housing 102, among others, may be formed from a thermoplastic material (self-reinforced or fiber reinforced), ABS, polycarbonate, polypropylene, polystyrene, PVC, polyamide, biaxially oriented polypropylene, and/or PTFE, among others. In some examples, the tow handle 232, among others, may be extruded from aluminum or other similar metal. In addition, the housing 102 may be formed from fiber reinforced epoxy, resin, or other similar material. The luggage article may be formed or molded in any suitable manner, such as by plug molding, blow molding, injection molding, extrusion, casting, or the like. As noted above, the luggage article may be formed from soft side material and/or hard side material. Exemplary materials are noted above. The split line as described herein may extend across the entirety of a major face, such as a front major face, and entirely across faces adjacent the major face, such as top and bottom faces, and may extend only partially across the rear major face. Where the split line extends only partially across the rear major face, the portion of the rear major face across which it does not extend may include the hinge structure, or other structure, that allows the shell portions to move relative to one another between an open and closed orientations.

All relative and directional references (including: upper, lower, upward, downward, left, right, leftward, rightward, top, bottom, side, above, below, front, middle, back, vertical, horizontal, and so forth) are given by way of example to aid the reader's understanding of the particular examples described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed examples teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. A luggage article comprising:

a housing defined by first and second shell portions pivotably connected together at a split line;

the housing defining a front major face, a rear major face, and a plurality of minor faces extending between the front and rear major faces, wherein the front and rear major faces have a width dimension greater than each of the plurality of minor faces;

a hinge having a pivot axis and pivotably connecting the first and second shell portions together along a portion of the split line, wherein the hinge is defined on the rear major face of the housing; and a retractable tow handle connected to the rear major face of the housing, the tow handle comprising one or more extensible tubes or poles and a grip portion connected to a distal end of each of the one or more extensible tubes or poles, wherein:

the tow handle is integrated into the hinge such that the tow handle extends along at least a part of the pivot axis, and the split line extending along the front and rear major faces of the housing, and the split line is a central vertical split line.

2. The luggage article of claim 1, wherein:

the plurality of minor faces comprises opposing top and bottom minor faces and opposing left and right minor faces; and the split line extends along the top and bottom minor faces.

3. The luggage article of claim 1, wherein in an open configuration the first and second shell portions define peripheral rims defining respective openings into a storage space, each opening having a length greater than its width.

4. The luggage article of claim 3, wherein the storage space in each shell portion is deeper than it is wide.

5. The luggage article of claim 1, wherein in an open configuration:

the rear major face forms a sidewall of each of the first and second portions; and the sidewalls defined by the rear major face are adjacent to each other.

6. The luggage article of claim 5, wherein the sidewalls engage and limit further pivoting of the first and second shell portions about a hinge.

7. The luggage article of claim 1, further comprising a closure mechanism securing the first and second shell portions together at the split line, the closure mechanism positioned along at least a portion of the split line on the front major face and opposite of the hinge.

8. The luggage article of claim 7, wherein:

the closure mechanism is a latch;

the latch is positioned within a recess defined in the housing; and the housing includes recessed portions defined in both the first shell portion and the second shell portion such that the recessed portions combine to define the recess when the first and second shell portions are connected together.

9. The luggage article of claim 1, wherein:

the tow handle is movable between a retracted position and an extended position, wherein in the retracted position the grip portion is positioned near or adjacent to one of the plurality of minor faces, and wherein in the extended position the grip portion is moved away from the one of the plurality of minor faces; and the grip portion is received in a recess formed in the housing and is generally flush with the one of the plurality of minor faces when the tow handle is positioned in the retracted position.

10. The luggage article of claim 9, wherein the grip portion extends parallel to the split line.

11. The luggage article of claim 1, further comprising:

a closure mechanism securing the first and second shell portions together at the split line, the closure mechanism positioned along at least a portion of the split line on one of the front and rear major faces and opposite of the hinge.

12. The luggage article of claim 11, further comprising:

the housing defining opposing front and rear panels, opposing top and bottom panels, and opposing left and right panels;

a plurality of spinner wheel assemblies connected to the bottom panel;

a first upper corner region defined by the intersection of at least the top panel and the right panel;

a first top carry handle positioned at or near the first upper corner region; and a first side carry handle positioned on the right panel of the housing.

13. The luggage article of claim 12, further comprising:

a second upper corner region defined by the intersection of at least the top panel and the left panel;

a second top carry handle positioned at or near the second upper corner region; and a second side carry handle positioned on the left panel.

14. The luggage article of claim 12, wherein each top carry handle and each side carry handle is positioned along a centerline of the housing between the front and rear major faces of the housing.

15. The luggage article of claim 12, wherein:

each top carry handle and each side carry handle is positioned within a respective recess defined in the housing; and each top carry handle and each side carry handle is biased to retract into its respective recess when not in use.

* * * * *